US007341013B2

(12) United States Patent
Yoshiki

(10) Patent No.: US 7,341,013 B2
(45) Date of Patent: Mar. 11, 2008

(54) SMALL PLANING WATERCRAFT

(75) Inventor: Futaki Yoshiki, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/290,638

(22) Filed: Nov. 30, 2005

(65) Prior Publication Data

US 2006/0137586 A1 Jun. 29, 2006

Related U.S. Application Data

(63) Continuation-in-part of application No. 11/207,332, filed on Aug. 19, 2005.

(30) Foreign Application Priority Data

Aug. 19, 2004 (JP) ..... 2004-239323

(51) Int. Cl.
*B63B 35/73* (2006.01)

(52) U.S. Cl. ..... 114/55.52; 114/55.54; 114/144 R; 114/283; 114/284

(58) Field of Classification Search ..... 114/55.5, 114/55.52, 55.54, 55.55, 55.57, 123, 144 R, 114/283, 284
See application file for complete search history.

(56) References Cited

U.S. PATENT DOCUMENTS

| | | | | | |
|---|---|---|---|---|---|
| 3,095,232 | A | | 6/1963 | Stevens | |
| 3,998,176 | A | * | 12/1976 | Stout et al. | 114/283 |
| 4,733,627 | A | * | 3/1988 | Nishida | 114/55.52 |
| 4,941,421 | A | * | 7/1990 | Anderson | 114/144 R |
| 4,989,532 | A | | 2/1991 | Kishi et al. | |
| 5,056,450 | A | * | 10/1991 | Mardikian | 114/144 R |
| 5,282,437 | A | | 2/1994 | Avillez de Basto | |
| 5,353,734 | A | | 10/1994 | Tani | |
| 2005/0016440 | A1 | | 1/2005 | Simard, et al. | |

FOREIGN PATENT DOCUMENTS

| | | | |
|---|---|---|---|
| JP | 58-129287 | | 9/1983 |
| JP | 2-169390 | * | 6/1990 |
| JP | 5-238476 | * | 9/1993 |
| JP | 05-201276 A | | 10/1993 |
| JP | 10-076990 | | 3/1998 |
| JP | 2757999 B | | 3/1998 |

OTHER PUBLICATIONS

Translation of Japan 2-169390.*
Product Advertisement of Seadoo 3D Premium. Website: http://www.seadoo.com/en-US/Watercrafts/2005/Sport/3D.Premium/Introduction.htm.

* cited by examiner

*Primary Examiner*—Sherman Basinger
(74) *Attorney, Agent, or Firm*—Knobbe, Martens, Olson & Bear, LLP

(57) ABSTRACT

A small planing watercraft can have a hull, an engine, and a steering assembly. The steering assembly can be configured to be translatable in the fore and aft direction, as well as pivotable about a generally horizontal axis so as to provide more flexibility in accommodating different. Optionally, a watercraft can include moveable members on a bottom surface of the hull so as to change a turning characteristic of the watercraft.

12 Claims, 39 Drawing Sheets

SMALL PLANING WATERCRAFT

PRIORITY INFORMATION

This application is a continuation-in-part application of U.S. patent application Ser. No. 11/207,332 filed Aug. 19, 2005 which claims priority to Japanese patent application Serial No. 2004-239323, filed on Aug. 19, 2004, the entire contents of each of which is hereby expressly incorporated by reference. Additionally, Japanese patent application Serial No. 2004-218402, filed on Jul. 27, 2004 and Japanese patent application Serial No. 2004-226049, filed on Aug. 2, 2004, are hereby expressly incorporated by reference.

BACKGROUND OF THE INVENTIONS

1. Field of the Inventions

The present inventions relate to a small planing watercraft, and more particularly to steering assemblies and adjustable planing surfaces for small planing watercraft.

2. Description of the Related Art

Small planing watercraft, such as those commonly referred to as "sit-down type personal watercraft," can be operated with the operator sitting on a seat that is fixed to a top portion of the hull. For example, Japanese Patent Publication JP-A-Hei05-201276 discloses such a design.

Other personal watercraft, such as the "stand-up-type," have no seat, and the rider operates the handlebars and throttle lever while standing on a floor section disposed in a rear portion of the hull. For example, Japanese Patent Publication JP-B-2757999 discloses such a watercraft.

Stand-up watercraft typically have a steering pole, the forward end of which is hingedly coupled with a front portion of the hull. This arrangement allows the pole to pivot in a vertical direction, i.e., about a generally horizontal pivot axis. The height of the steering handlebars disposed at a rear end of the steering pole can thus be adjusted by the operator.

SUMMARY OF THE INVENTIONS

An aspect of at least one of the embodiments disclosed herein includes the realization that by modifying a steering assembly of a watercraft so that the handlebars or grips are translatable in a fore to aft direction, different operators can be more easily accommodated. For example, but without limitation, by configuring a steering assembly to be both pivotable about a generally horizontal axis, and translatable in the fore to at direction, riders can comfortably adopt different riding positions.

Thus, in accordance with an embodiment, a steering system is provided for a small planing watercraft having a hull and a steering pole repositionable by a rider in accordance with his or her own physique or posture. The steering system can comprise an engaging portion provided on each side of a forward end portion of the steering pole and an engaged portion provided on the upper forward portion of the hull in the fore to aft direction of the hull. The engaged portion can be engageable with the engaging portion such that the steering pole is translatable in the fore to aft direction of the hull.

Another aspect of at least one of the embodiments disclosed herein includes the realization that by allowing the orientation of a planing surface of a watercraft to be modified, a rider can change the handling characteristics of the watercraft during operation. For example, during straight ahead travel, the planing surface of a small watercraft can be maximized to achieve a stable cruising state. However, if the watercraft is turned with a steep banking angle, the inlet of the jet pump can rise out of the water, and cavitate. On the other hand, if the planing surface of the watercraft is raised, the inlet can be kept in contact with the water, even during turns at larger banking angles.

Thus, in accordance with another embodiment, a small planing watercraft can comprise a watercraft body, a plurality of mounting recesses disposed at boundary portions in a rear part of a watercraft body between sides and a bottom thereof, and a plurality of auxiliary bodies mounted to respective mounting recesses. At least one lifting mechanism can be configured to change a vertical position of the auxiliary bodies, the auxiliary bodies defining at least part of a planing surface of the watercraft body when the auxiliary bodies are held at lowered positions.

In accordance with yet another embodiment, a watercraft can comprise a hull and a propulsion unit supported by the hull. The hull can include at least one member having a downwardly facing surface defining at least a portion of a planing surface of the hull during planing mode operation of the watercraft. At least a portion of the at least one member can be mounted so as to be moveable such that the portion of the planing surface can be moved in a generally vertical direction.

In accordance with a further embodiment, a watercraft can comprising a hull and a propulsion unit supported by the hull. The hull can include at least one member having a downwardly facing surface defining at least a portion of a planing surface of the hull during planing mode operation of the watercraft. Additionally, the watercraft can include means for adjusting the vertical position of the portion of the planing surface during operation o the watercraft.

DETAILED DESCRIPTION OF THE PREFERRED EMBODIMENTS

Figure 1:
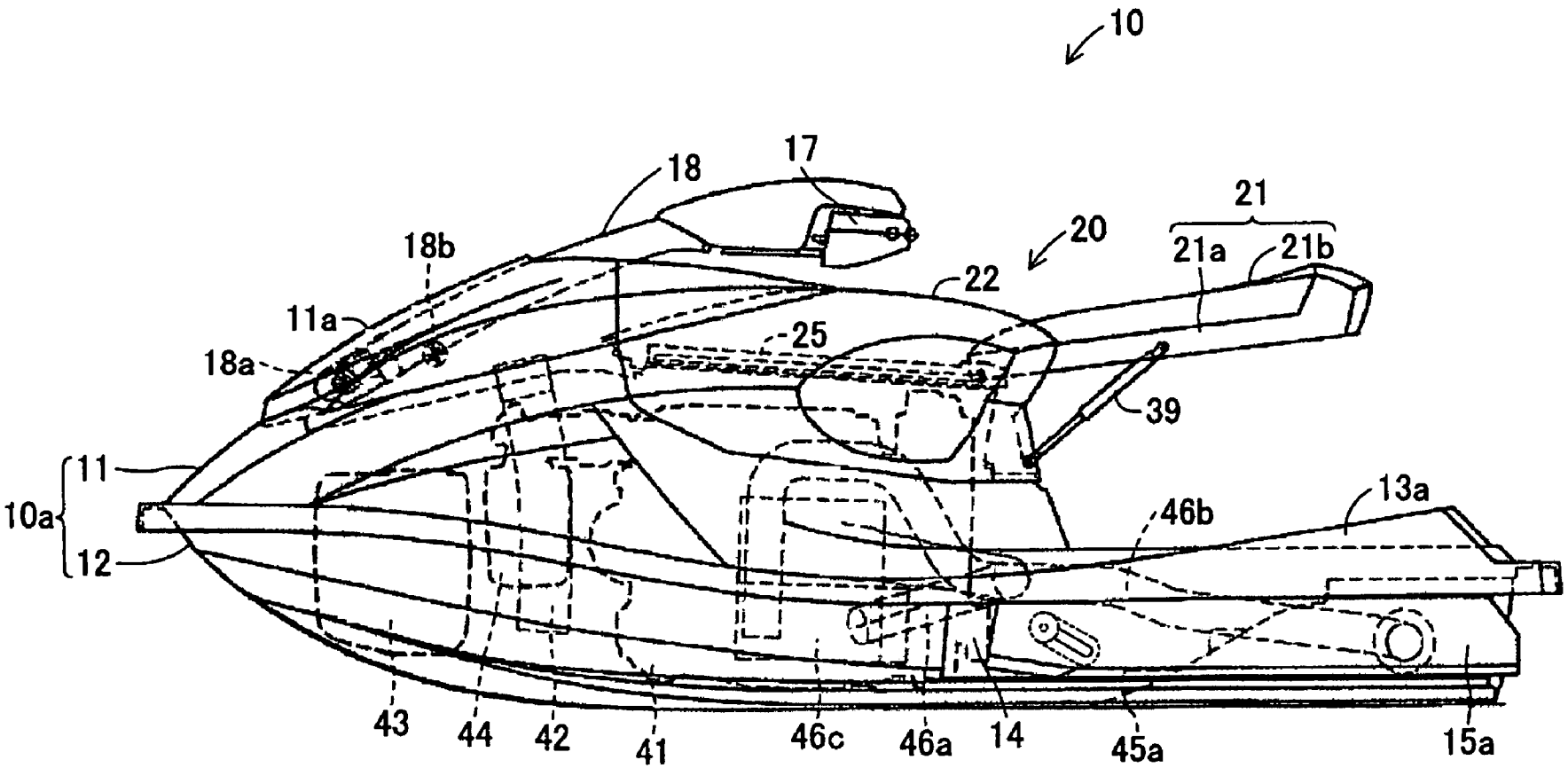
FIG. 1 is a side elevational view of a small planing watercraft with a seat structure configured in accordance with an embodiment, with certain internal components illustrated in phantom.

FIG. 1 illustrates a small planing type watercraft 10 having a seat in accordance with several embodiments. The present seat arrangement is disclosed in the context of a personal watercraft because it has particular utility in this context. However, the seat arrangement can be used in other contexts, such as, for example, but without limitation, other types of watercraft and other vehicles including land vehicles.

Figure 2:
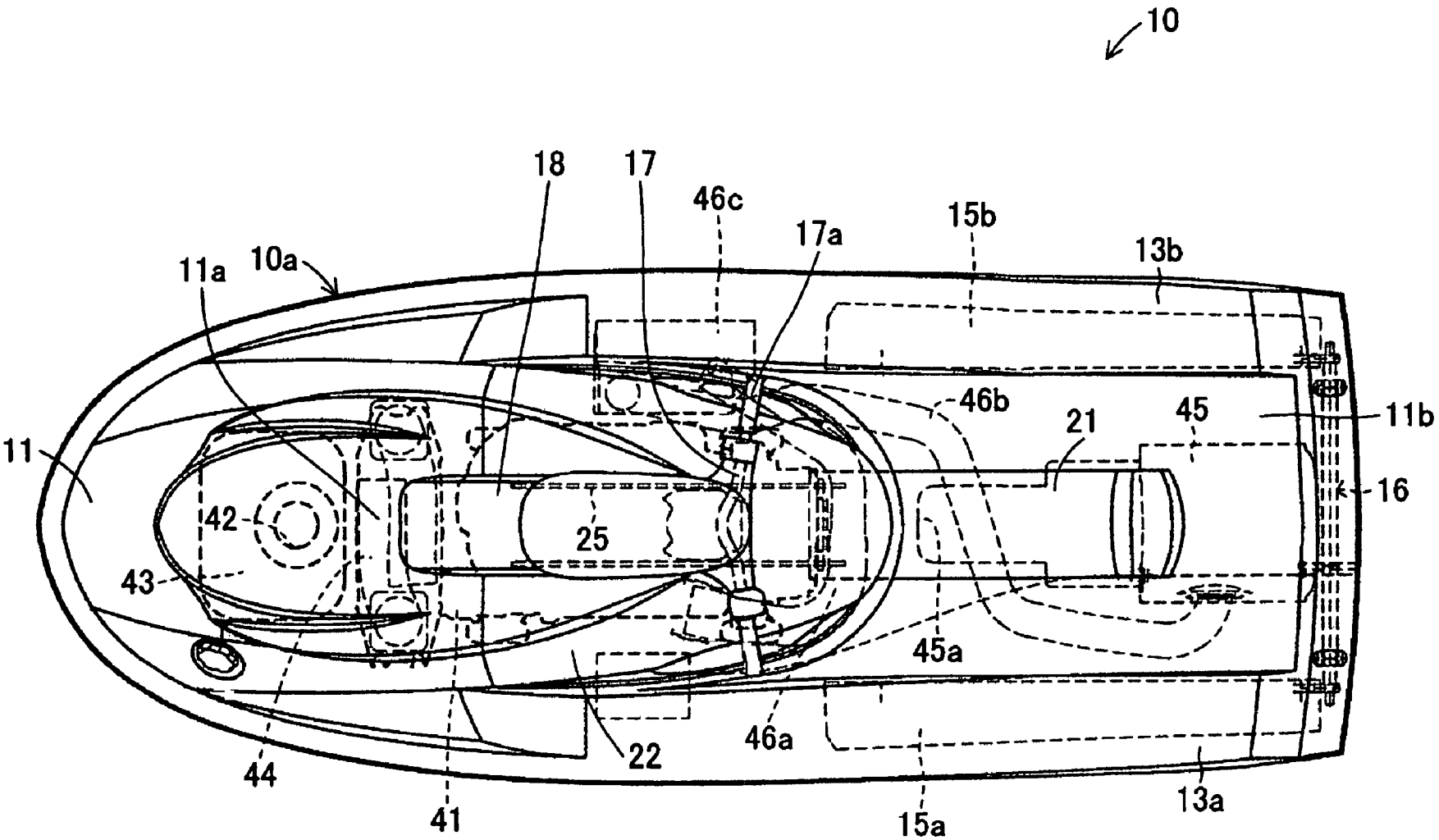
FIG. 2 is a top plan view of the small planing watercraft of FIG. 1.

FIGS. 1 and 2 show a small planing watercraft 10 having a seat structure 20 configured in accordance with an embodiment. A hull 10*a* of this small planing watercraft 10 comprises a deck 11 that forms an upper portion of the hull 10*a* and a lower hull 12.

A forward portion of the deck 11 is formed with a front deck section 11*a* that rises upwardly. A rear portion of the deck 11 has a recessed floor section 11*b* on which the rider can stand. Each of right and left ends of the floor section 11*b* has a side wall 13*b*, 13*a*, respectively.

A lower outer side (lower hull 12) of each side wall 13*a*, 13*b* can have an attachment aid recess 14 (the attachment aid recess for the side wall 13*b* is not shown). A supplemental hull component 15*a*, 15*b* can be attached to the respective attachment aid recesses 14.

Each supplemental hull component 15*a*, 15*b* can be placed so that its position is adjustable in a vertical direction by a lifting mechanism 16 that can be formed with a rotationally driving device or the like. Each supplemental hull component 15*a*, 15*b* can be configured to define a portion of a planing surface. For example, the supplemental hull component 15*a*, 15*b* can be sufficiently side to widen the planing surface of the hull 12 by a chine width. The buoyancy of the small planing watercraft 10 thus can be increased, and the stability thereof can be improved. The chine width becomes smaller when the respective supplemental hull components 15*a*, 15*b* are positioned higher. Thus, the small planing watercraft 10 can be provided with a larger bank angle during turning.

Steering handlebars 17 can have handling grips 17*a* and can be disposed so as to extend above a generally center portion of the hull 10*a* in the fore to aft direction thereof. A seat 21 can be disposed in the rear of the steering handlebars 17. The steering handlebars 17 can be connected to the hull 10*a* through a connecting pole 18 that is attached thereto for pivotal movement in the vertical direction about an axis of a support shaft 18*a*. Also, the steering handlebars 17 can be coupled with a rear end of the connecting pole 18 for pivotal movement in the right or left direction about an axis at the rear end of the connecting pole 18. The steering handlebars 17 and the connecting pole 18 together form a steering pole.

Figure 3:
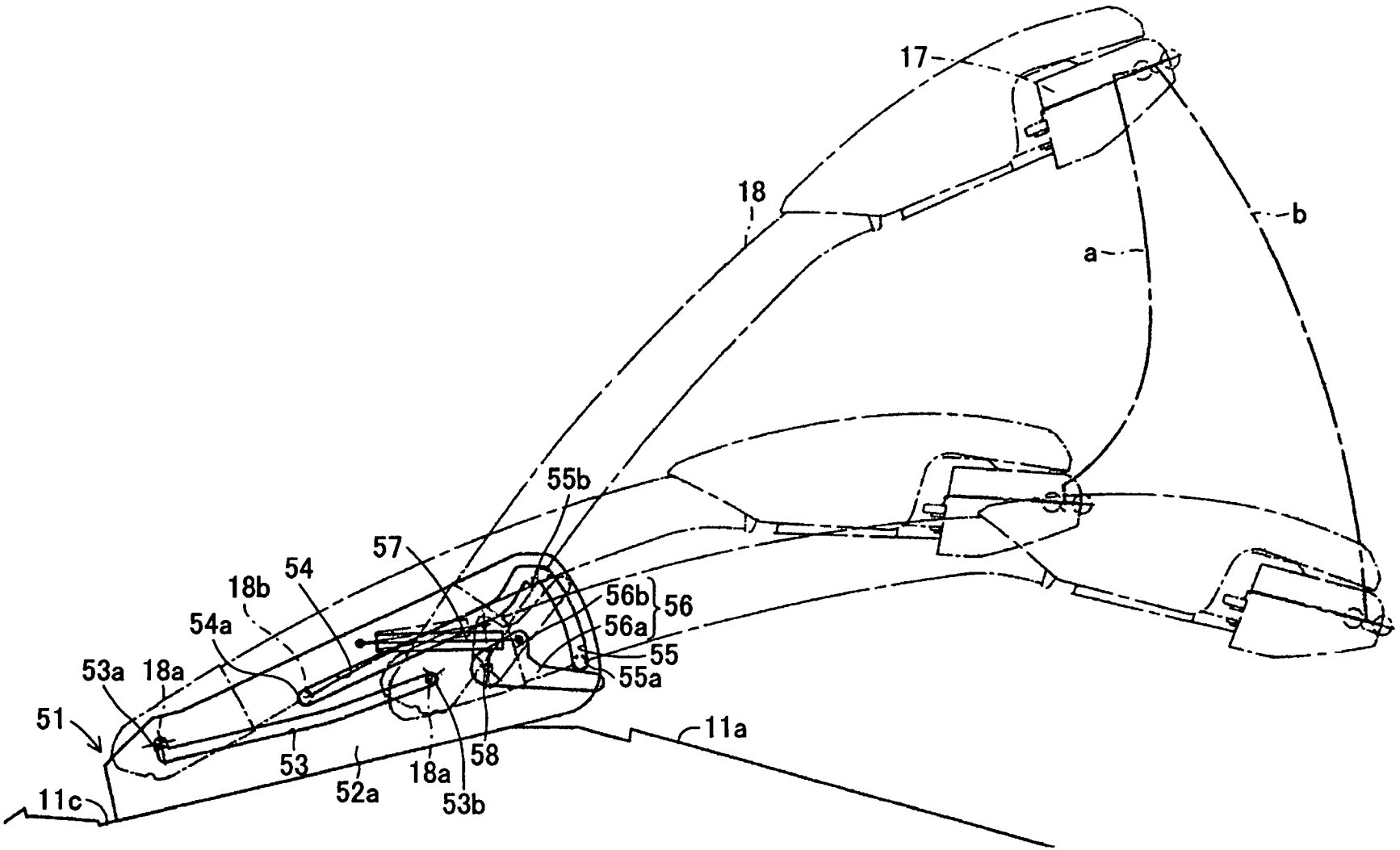
FIG. 3 is an enlarged side elevational view of the handlebars of the watercraft of FIG. 1, showing different optional positions between which the handlebars can be moved.
Figure 4:
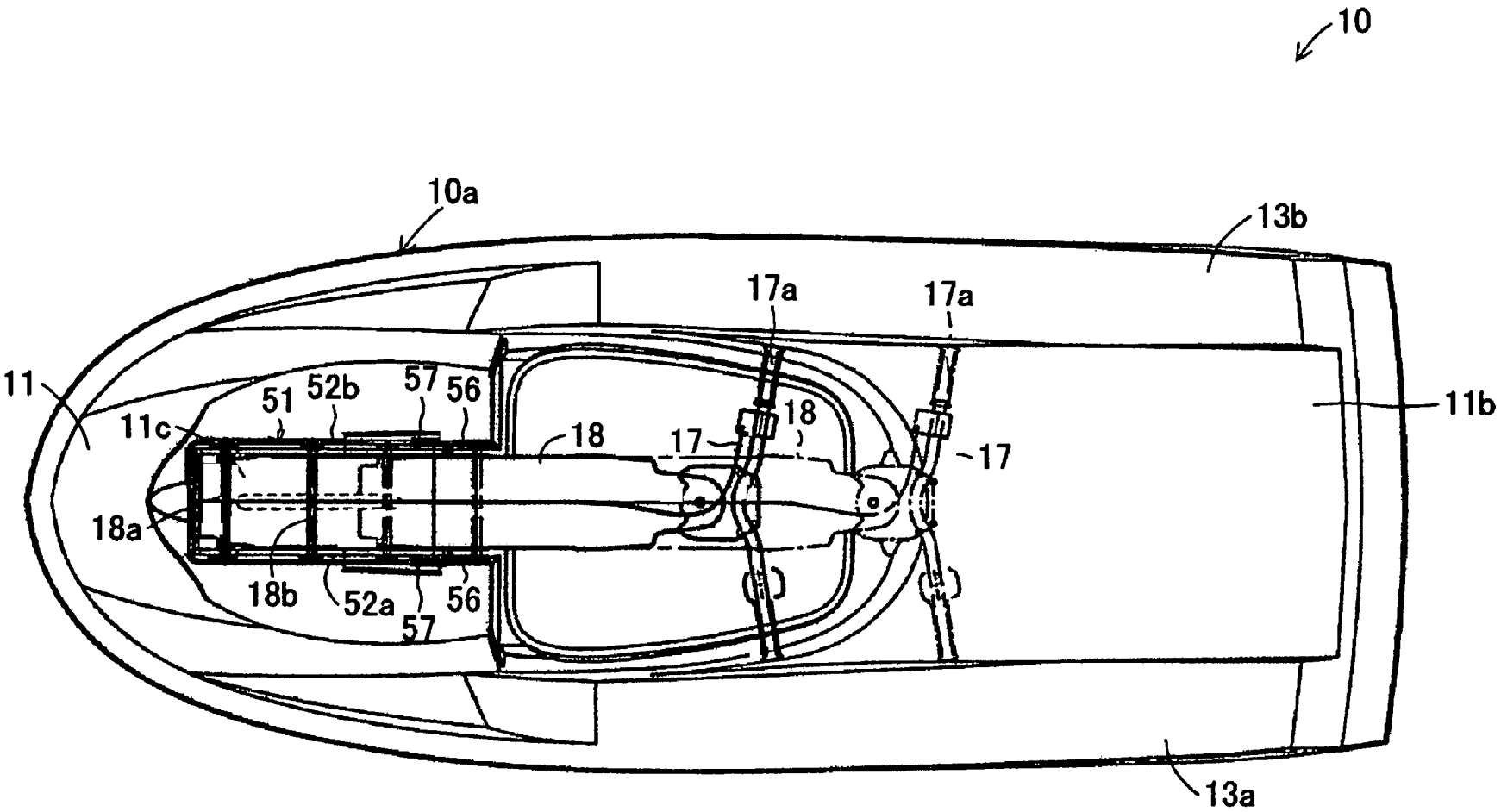
FIG. 4 is a top plan view of the watercraft of FIG. 1 showing the handlebars in the maximum forward and rearward optional positions.

The connecting pole 18 can be attached to a top surface of the front deck section 11*a* in a manner shown in FIGS. 3 and 4. That is, the top surface of the front deck section 11*a* can have a storage support section 51 that can be configured to receive a front end portion of the connecting pole 18 under a reciprocally movable condition and also support it.

The storage support section 51 can have a box-like concave configuration with its rear end being open. An outer surface of the front deck section 11*a* can form a top surface of the storage support section 51, and a base portion 11*c* of the front deck section 11*a* can form a bottom surface of the section 51.

Plate-like brackets 52*a*, 52*b* can be used to form both side surfaces of the section 51. Each bracket 52*a*, 52*b* can have a slide groove 53 configured for supporting a shaft and a slide groove 54 configured for supporting a guide shaft (both slide grooves of each bracket 52*a*, 52*b* are not shown).

Each support shaft slide groove 53 can be a slot that extends along a slope of the base portion 11*c* of the front deck section 11*a*. The grooves 53 can slope slightly upwardly toward its rear end from its front end. A slope angle of a rear portion of the slot is preferably larger than a slope angle of a front portion thereof.

An upper forward edge of the support shaft slide groove 53 can have a support shaft engagement recess 53*a*. The support shaft engagement recess 53*a* can extend upwardly with a width that is the same as that of the support shaft slide groove 53. Preferably, a configuration of a top end of the recess 53*a* is generally a semi-circle in a side view.

Each guide shaft slide groove 54 can be a slot positioned above and in the rear of the support shaft slide groove 53 of each bracket 52*a*, 52*b*. Each guide shaft slide groove 54 can extend upwardly and rearwardly from a location generally above a center portion of the support shaft slide groove 53, and its rear portion can be formed with an arcuate groove section 55. A slope angle of a front portion of the guide shaft slide groove 54 is preferably larger than the slope angle of the rear portion of the support shaft slide groove 53. A rear end of the front end portion of the guide shaft slide groove 54 curves upwardly and communicates with the arcuate groove section 55 in the rear of the curve.

The arcuate groove section 55 can be arcuately formed with its center of curvature positioned at a rear end 53*b* of the support shaft slide groove 53. Preferably, the height of a bottom end 55*a* of the arcuate groove section 55 is generally equal to the height of the rear end 53*b* of the support shaft slide groove 53.

The arcuate groove section 55 can have a guide shaft engagement recess 55*b* at a lower edge of its portion where the rear end of the front end portion of the arcuate guide shaft slide groove 54 intersects a top end of the arcuate groove section 55. Preferably, a configuration of the guide shaft engagement recess 55*b* is generally a semi-circular in a side view, for example.

A lever 56 and a spring 57 can be attached to an outer surface of each bracket 52*a*, 52*b*. Each lever 56 can have a hook shape with a long leg 56*a* and a short leg 56*b*.

With continued reference to FIG. 3, a pivot shaft 58 can be used to support a base end of the lever 56 for pivotal movement. The spring 57 can extend between a top end of the short leg 56*b* and a generally center portion of a top outer surface of each bracket 52*a*, 52*b* to bias the long leg 56*a* of the associated lever 56 upwardly. The long leg 56*a* extends to a rear portion of the arcuate groove section 55 so that a rear end (top end) of the spring reaches the position of the guide shaft engagement recess 55*b* when the spring 57 shrinks toward its minimum length.

The front end of the connecting pole 18 can have an aperture extending transversely. The support shaft 18*a* can extend through the aperture. Both ends of the support shaft 18*a* can protrude beyond respective side surfaces of the connecting pole 18 and enter the respective support shaft slide grooves 53.

The guide shaft 18*b* can be affixed to a lower portion of the connecting pole 18 located in the rear of the support shaft 18*a*. Both ends of the guide shaft 18*b* can extend into the respective guide shaft slide grooves 54.

Preferably, the guide shaft 18*b* is positioned at a front end 54*a* of the guide shaft slide groove 54 when the support shaft 18*a* is positioned at a front end of the support shaft slide groove 53. The guide shaft 18*b* can be positioned at the arcuate groove section 55 when the support shaft 18*a* is positioned at a rear end 53*b*. The support shaft 18*a*, the support shaft engagement recess 53*a*, the guide shaft 18*b* and the guide shaft engagement recess 55*b* together can form a movement preventing mechanism.

Figure 5:
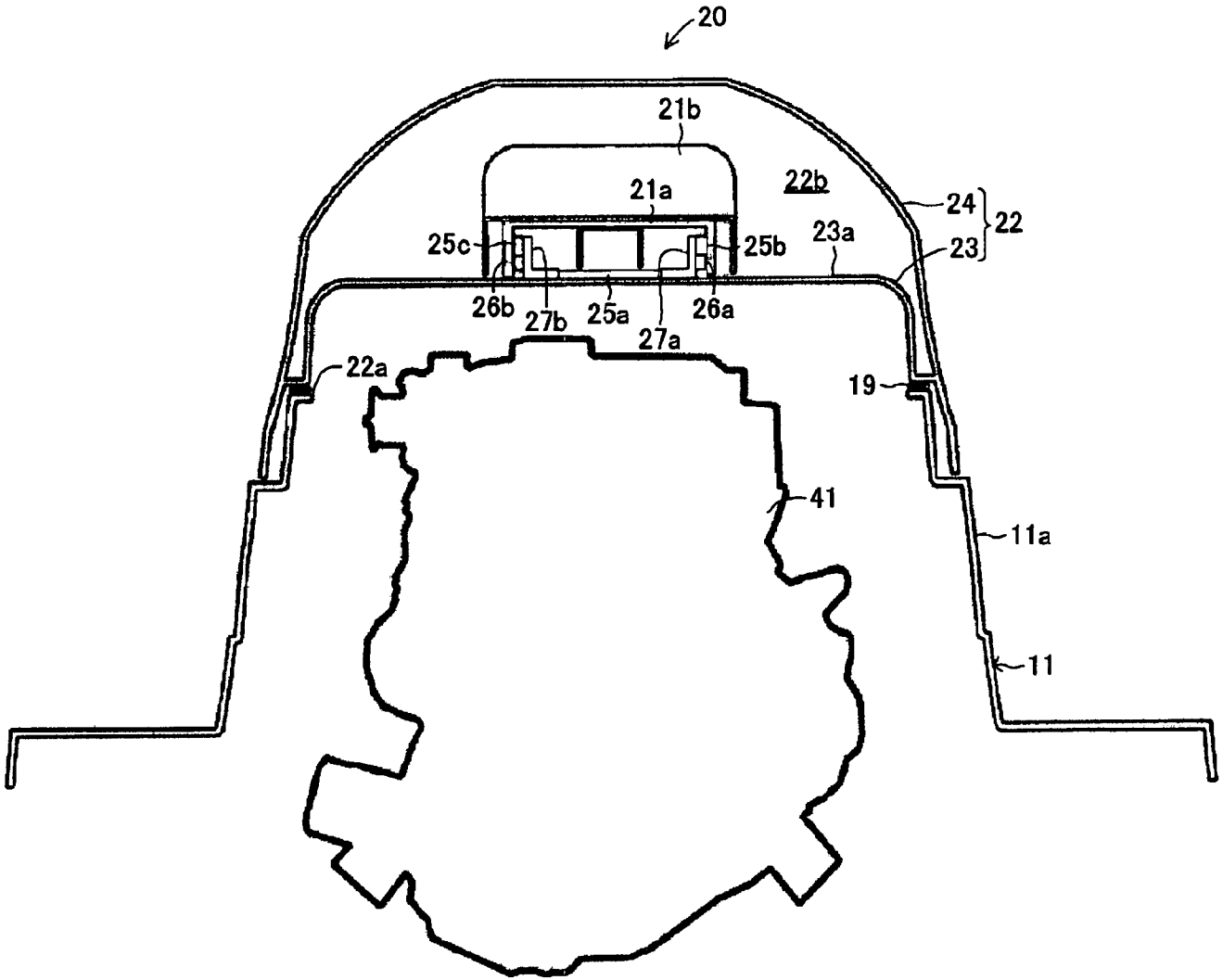
FIG. 5 is a partial schematic cross-sectional view of a portion of the small planing watercraft of FIG. 1, illustrating a portion of the seat structure thereof.
Figure 6:
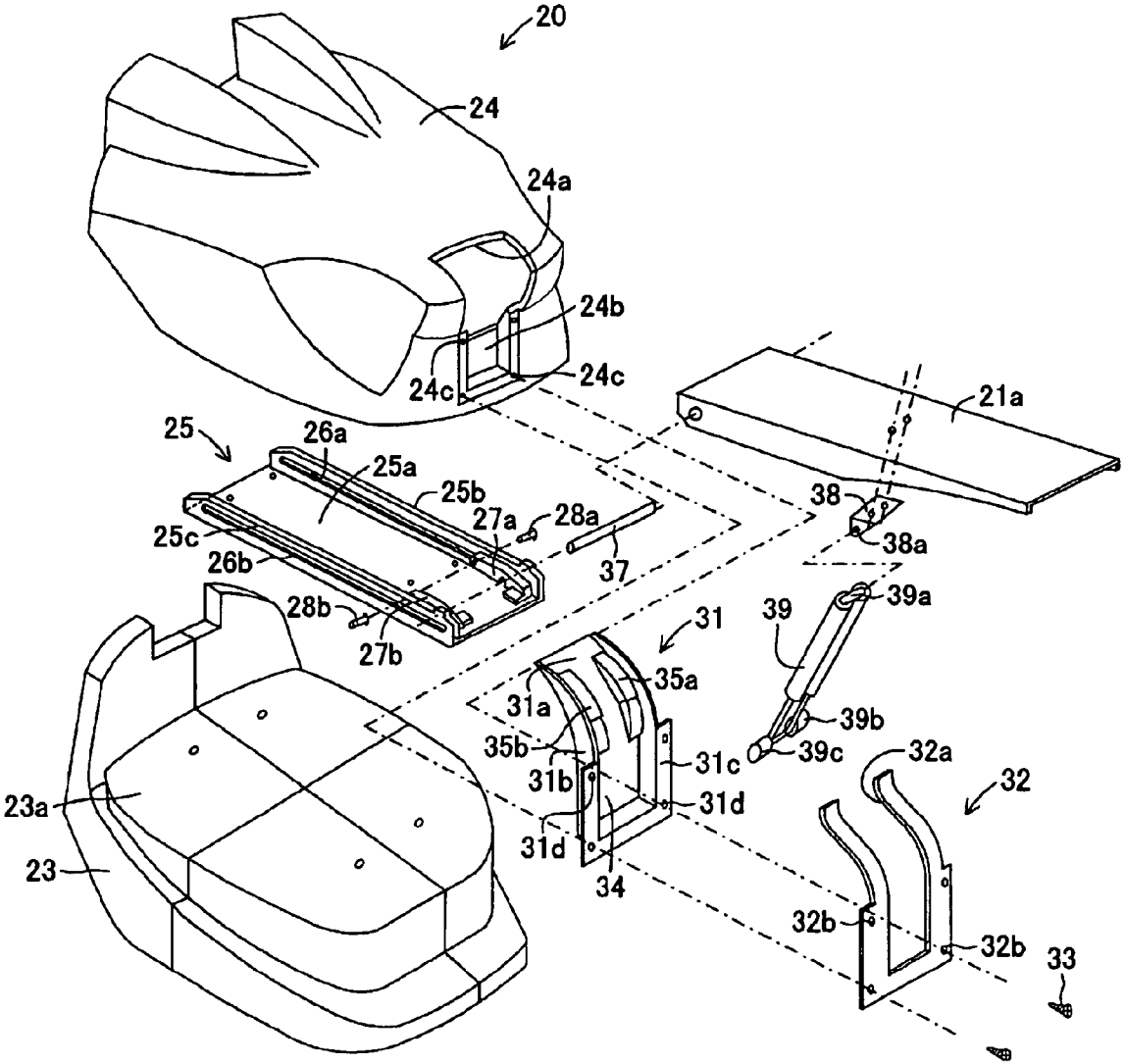
FIG. 6 is an exploded view of the seat structure of the watercraft.

With reference to FIGS. 1, 5, and 6, the seat 21 can be disposed in the rear of the hatch cover 22 that is formed in an upper rear portion of the front deck 11*a*. The seat 21 can also be movable relative to the hatch cover 22 to extend from or be retracted to the hatch cover 22.

For example, as shown in FIG. 5, the upper rear portion of the front deck 11*a* can define an engine hatch 22*a*. The hatch cover 22 can be disposed for selectively closing and opening the engine hatch 22*a*. A seal 19 can be interposed between the body of the front deck section 11*a* and the hatch cover 22 to for a substantially water-tight seal therebetween. The seat structure 20 can comprise the seat 21, the hatch cover 22; the engine hatch 22*a* and as well as other components. FIG. 6 shows an exploded view of the seat structure 20.

With continued reference to FIG. 6, the hatch cover 22 can be an assembly of an inner cover 23 and an outer cover 24. The inner cover 23 can be positioned within the front deck section 11*a*, and the outer cover 24 can be used to form an outer surface of the front deck section 11*a*.

The inner and outer covers 23, 24 can form a storage space 22*b* therebetween. That is, the inner cover 23 can be a cover member having a platform 23*a* which top surface can be generally flat, although the top surface 23*a* can have other shapes and/or contours. The outer cover 24 can be a curved cover member extending over the inner cover 23 to define the storage space 22*b* above the top surface of the platform 23*a* of the inner cover 23.

The outer cover 24 can have an opening 24*a* extending between a top rear end portion and a lower rear portion. The outer cover 24 can also have a recessed portion 24*b* extending below the opening 24*a* in a rear surface of the outer cover 24 for receiving a guide assembly, which is described below in greater detail.

The recessed portion 24*b* can have four peripheral corners, each of which, in some embodiments, has a screw hole 24*c*. The four screw holes 24*c* can be spaced apart from each other. A base member 25 can be affixed to the top surface of the platform 23*a* of the inner cover 23 by fastening screws (not shown) to extend in the fore to aft direction.

The base member 25 can have a rectangular bottom surface section 25*a* which is elongated and can extend in the fore to aft direction. The base member 25 can also have a pair of side edge portions which extend along respective side edges of the bottom surface section 25*a* in the longitudinal direction.

Each side edge portion can have a rail section 25*b*, 25*c* that has a relatively low side surface. Each rail section 25*b*, 25*c* can have a slide slot 26*a*, 26*b* that can form a slide recess. Each slide slot 26*a*, 26*b* can transversely penetrate the respective rail section 25*b*, 25*c* and can extend generally in the longitudinal direction.

Engagement arm sections 27*a*, 27*b* can extend along respective inner surfaces of the rail sections 25*b*, 25*c* that are opposite each other. Each engagement arm section 27*a*, 27*b* can be affixed to the respective rail section 25*b*, 25*c* by a support shaft 28*a*, 28*b* at an upper location in its rear portion (at a position higher than the slide slot 26*a*, 26*b*) for pivotal movement in the vertical direction.

Figure 7:
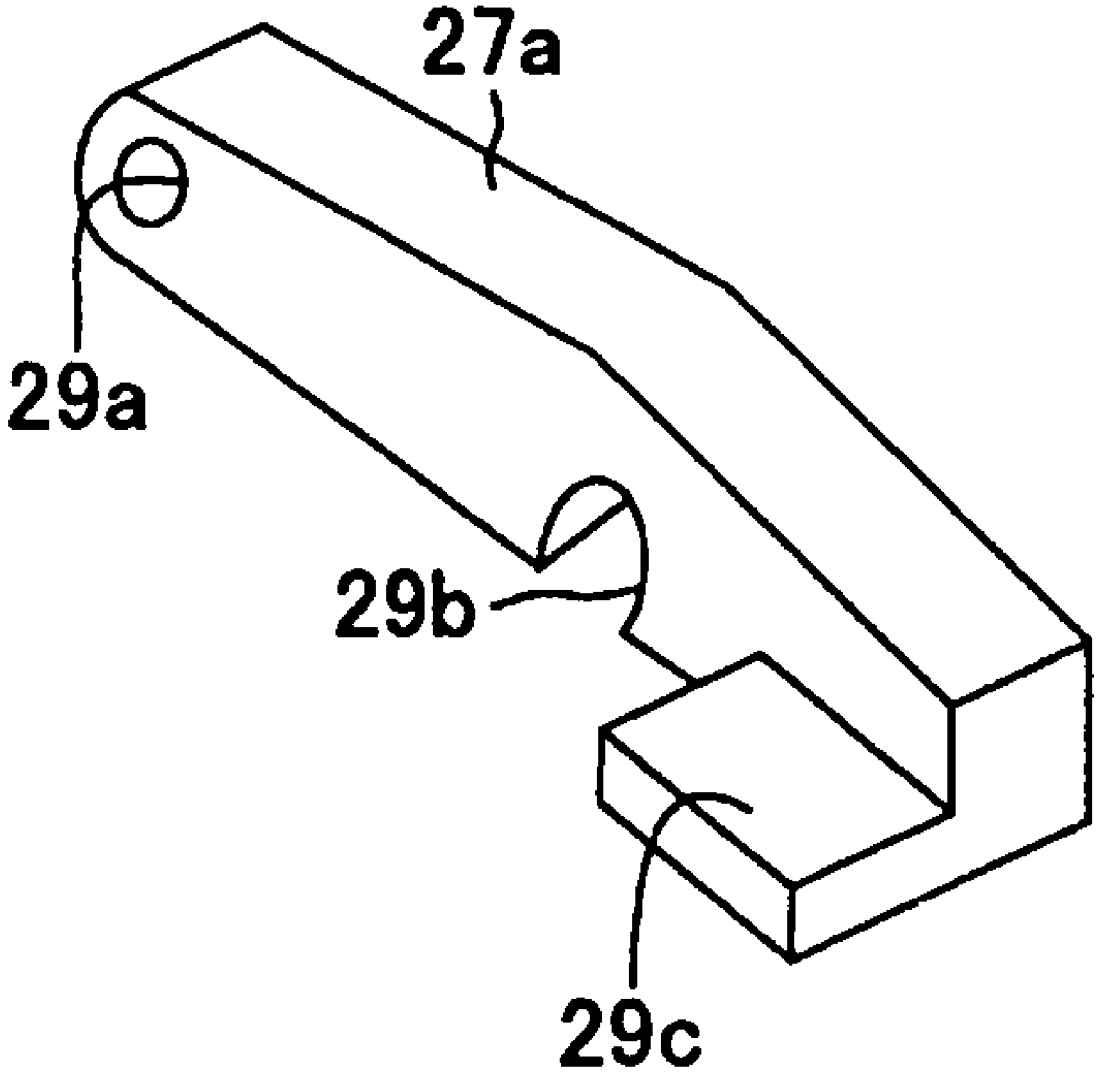
FIG. 7 is an enlarged perspective view of an engagement arm section of the seat structure of FIG. 6.

As shown in FIG. 7, the engagement arm section 27*a* can be formed with a member that extends in the fore to aft direction, and has a shaft hole 29*a* through which the support shaft 28*a* extends. The engagement arm section 27*a* can also have an engagement recess 29*b* formed in a bottom surface and at a slightly rear position than a center portion of the arm section 27*a*.

A raisable portion 29*c*, which can have a rectangular parallelepiped shape, can extend generally horizontally inwardly from a bottom side of a rear end of the engagement arm section 27*a*. The engagement arm section 27*b* can have bilateral symmetry with the engagement arm section 27*a*, and can be affixed to the rail section 25*c* by the support shaft 28*b* for opposing to the engagement arm section 27*a*. However, other configurations can also be used.

A rear end portion of the base member 25 can be coupled with a guide groove forming member 31, which can be a component of the guide assembly. The guide groove forming member 31 can comprise a guide surface section 31*a*, a wall section 31*b* and a fixed piece section 31*c*.

The guide groove forming member 31 can be affixed to a rear end portion of the outer cover 24 with the fixed piece section 31*c* fixed to the recessed portion 24*b*. The guide surface section 31*a* can have an upper portion coupled with a rear end of the bottom surface section 25*a* of the base member 25. The upper portion can extend rearward and gradually curve from the bottom surface section 25*a* of the base member 25, downwardly. The guide surface section 31*a* can also have a lower portion extending generally vertically from the upper portion. That is, the guide surface section 31*a* can be formed with a curved plate-like body.

The wall section 31*b* can extend rearwardly (in the direction normal to the guide surface section 31*a*) along respective side edges and a bottom edge of the guide surface section 31*a*. Lower part of the wall portion 31 can have a fixed width, while the upper part thereof can be tapered upwardly. The fixed piece section 31*c* can be a flange that extends outwardly (transversely and downwardly) from the side edges and the bottom edge of the wall section 31*b*. Four corners of the fixed piece section 31*c* individually can have screw holes 31*d*. The four screw holes 31*d* can be are spaced apart from each other.

A guide opening forming member 32, which can be another component of the guide assembly, can be placed on a rear surface of the guide groove forming member section 31 and can be affixed to the fixed piece section 31*c* of the guide groove forming member 31. The guide opening forming member 32 can be a plate that has a configuration generally similar to the entire configuration of the rear surface of the guide groove forming member 32 except for a guide opening 32*a*, although other configurations can also be used.

The guide opening 32*a* can be a relatively large slit that can be defined in a center area of the plate and is open upward. A portion of the guide opening forming member 32 corresponding to the fixed piece of the guide groove forming member 31 can have four screw holes 32*b* spaced apart from each other. Four fastening screws 33 (only two of which are shown) can be inserted into the respective screw holes 32*b*, 31 *d* and are screwed onto the screw holes 24*c*. Thus, the guide groove forming member section 31 and the guide opening forming member 32 are affixed to the outer cover 24. The guide groove forming member section 31 and the guide opening forming member 32 together can define a groove or space that forms a guide groove 34.

Figure 8:
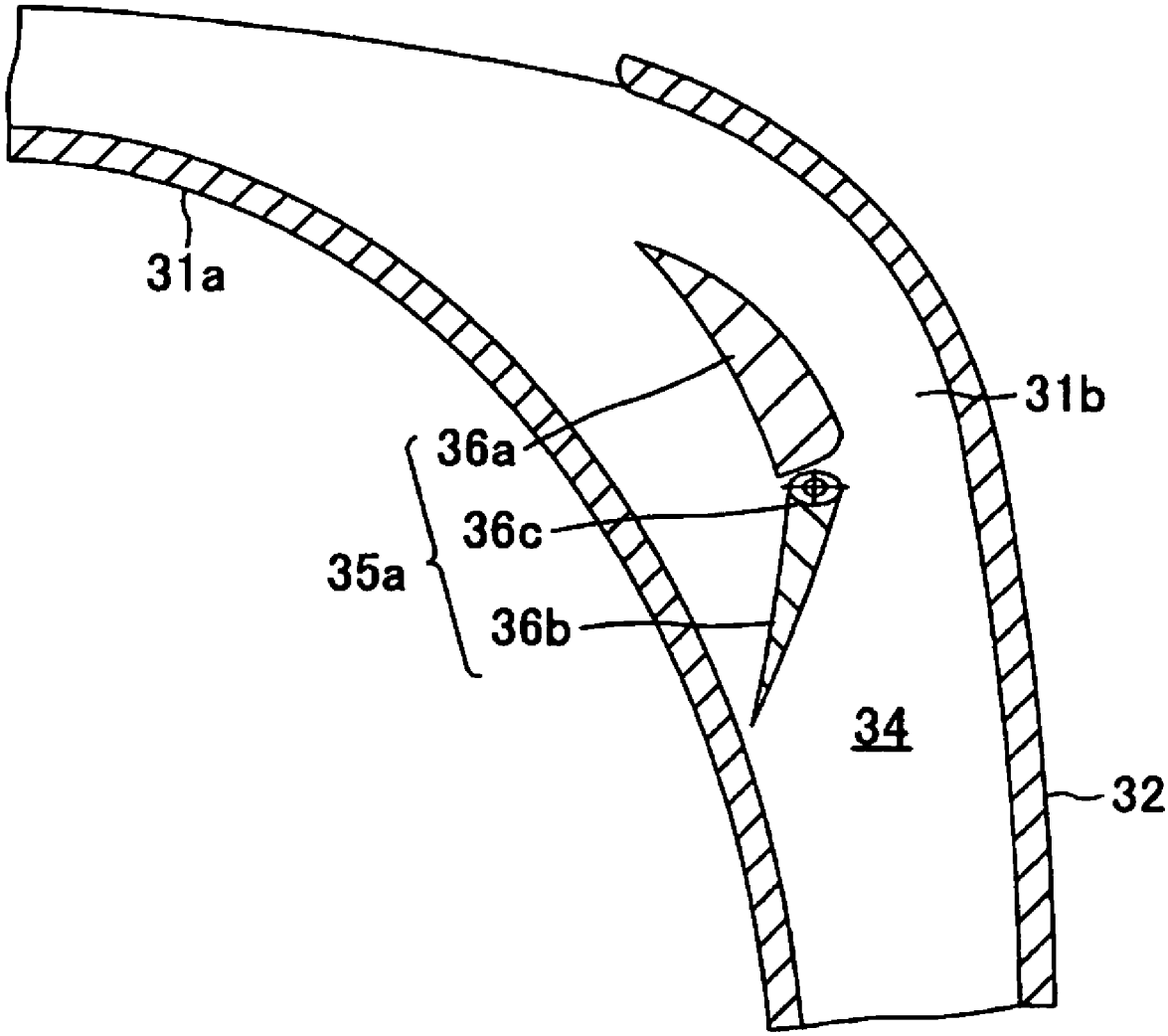
FIG. 8 is an enlarged cross-sectional view of a guide piece unit of the seat assembly, showing an attached state of the guide piece unit.

Guide piece units 35*a*, 35*b* can be attached to the guide groove forming member section 31 at both right and left sides in an upper area of the guide groove 34. As shown in FIG. 8, the guide piece unit 35*a* can include a fixed piece 36*a*, a swingable piece 36*b*, and a support shaft 36*c*.

The fixed piece 36*a* can be fixedly formed on an inner surface of the wall section 31*b* to curve along the upper area of the guide groove 34. The fixed piece 36*a* can be formed with a member that can be tapered upwardly.

The swingable piece 36*b* can be affixed to the support shaft 36*c* for pivotal movement and can be formed with a member tapered downwardly. The support shaft 36*c* can be affixed to the inner surface of the wall section 31*b*.

The swingable arm 36*b* can extend downwardly from the support shaft 36*c* such that a bottom end thereof is disposed in the lower-most position under a normal condition. Also, under the normal condition, the bottom end can be spaced apart narrowly from the guide surface section 31*a* and broadly from the guide opening member 32.

The seat 21 can have a movable section 21*a* that can be formed with an elongated plate that can extend in the fore to aft direction. A cushion 21*b* can be affixed to a top surface of the movable section 21*a*.

A rear end surface of the seat 21 can be configured to fit in the opening 24*a*. In some embodiments, the rear end surface of the seat 21 can be configured to fit in the opening 24*a* tightly, e.g., without leaving any spaces. Thus, a rear end surface of the hatch cover 22 can appear to have no substantial irregularities when the seat 21 is retracted within the hatch cover 22.

Side walls can extend downwardly from both edges of the movable section 21*a* and in the longitudinal direction. A slide pin 37 can extend transversely between respective forward end portions of the side walls. Each end of the slide pin 37 can extend beyond the side wall to engage the respective slide slot 26*a*, 26*b* of the rail section 25*b*, 25*c* so as to be movable in the fore to aft direction along the associated slide slot 26*a*, 26*b*.

Further, when the slide pin 37 moves to the rear portions of the slide slots 26*a*, 26*b*, each end of the slide pin 37 raises the rear end portion of the respective engagement arm section 27*a*, 27*b* and engages with the respective engagement recess 29*b*. Thus, the seat 21 can be prevented from coming off from the base member 25. Also, under such circumstances, the seat 21 can be pivotable in the vertical direction about an axis of the slide pin 37.

With continued reference to FIG. 6, a connecting member 38 can be affixed to a bottom surface of the movable section 21*a* generally at a center portion in the fore to aft direction. The connecting member 38 can have a shaft hole 38*a* extending generally transversely.

A support unit 39 can be coupled with the connecting member 38 such that a pivot shaft 39*a* of the support unit 39 extends through the shaft hole 38*a*. The support unit 39 can comprise any type of damper, each length of which can be adjustable. In some embodiments, the dampers can be gas dampers, hydraulic dampers, struts, or any other type of dampening device.

Thus, the entire length of the support unit 39 can be changeable. In addition, the support unit 39 can absorb shocks with the dampers. The support unit 39 can have a pair of rods extending in a lower portion of the unit 39. Each bottom end of the rod can have a projection 39*b*, 39*c* extending outwardly. Each projection 39*b*, 39*c* can have a columnar roller shape.

Figure 9:
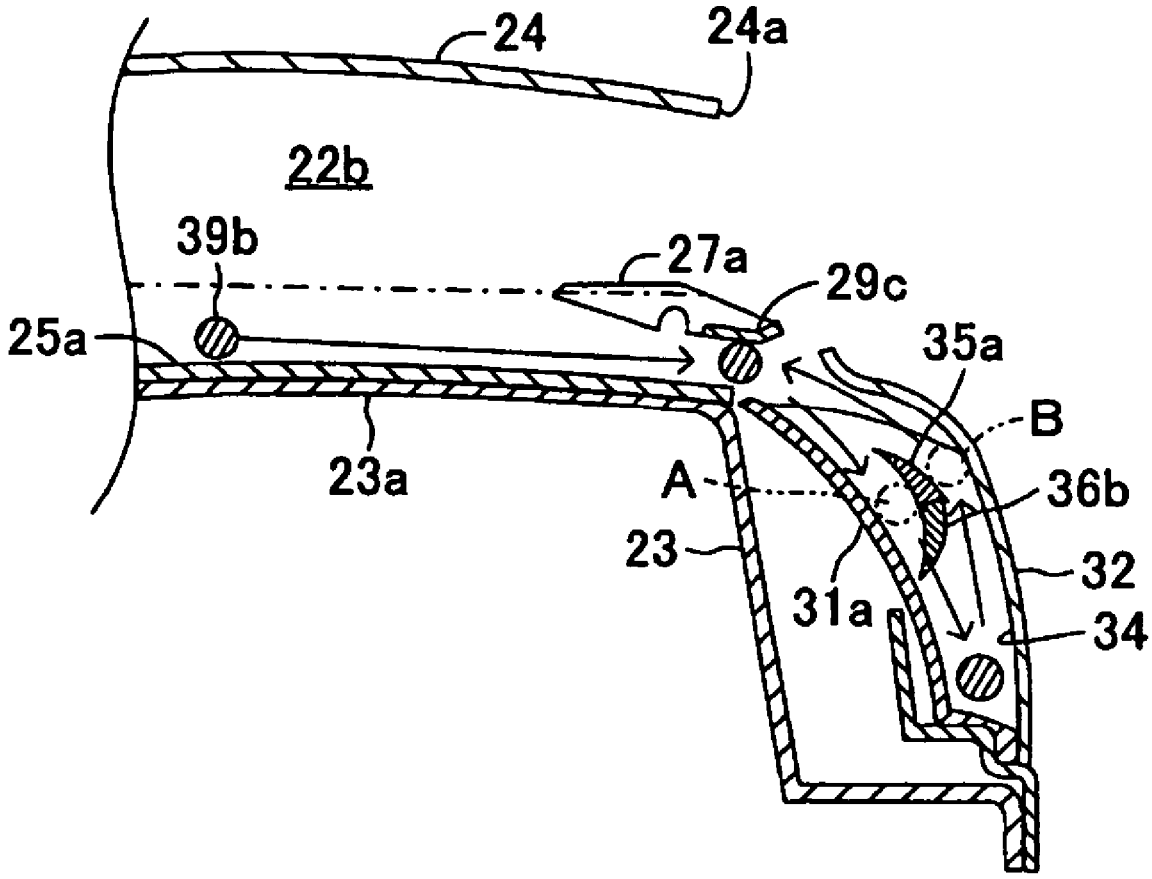
FIG. 9 is a cross-sectional view of a portion of a support unit of the seat assembly, illustrating a movement of a projection of the support unit.

As shown in FIG. 9, each projection 39*b*, 39*c* can be movable between an upper area of the bottom surface section 25*a* of the base member 25 and the inside of the guide groove 34. That is, each projection 39*b*, 39*c* moves along the bottom surface section 25*a* and the guide surface section 31*a* when each projection 39*b*, 39*c* passes toward a lower area of the guide groove 34 from the front end portion of the bottom surface section 25*a*. While moving, each projection 39*b*, 39*c* raises the raisable portion 29*c* and passes below a bottom side of the engagement arm section 27*a*, 27*b*. Each projection 39*b*, 39*c* also pushes the swingable piece 29 rearward and passes between the guide surface section 31*a* and the swingable piece 36*b*.

Figure 10:
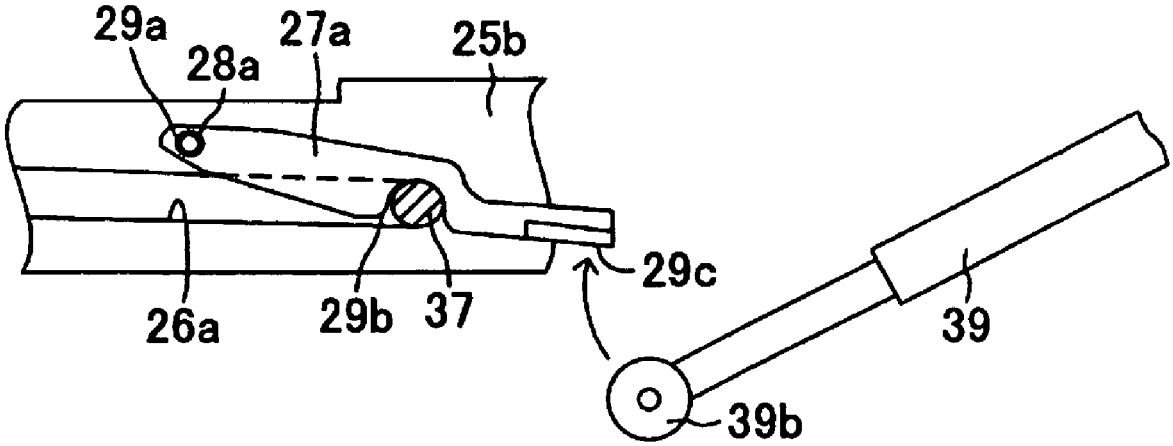
FIG. 10 is a schematic side elevational view of a condition under which the projection of the support unit raises a rear portion of the engagement arm section.

Each projection 39*b*, 39*c* passes between the swingable piece 36*b* and the guide opening forming section 32 when the projection 39*b*, 39*c* moves upward from the lower area of the guide groove 34. Further, as shown in FIG. 10, each projection 39*b*, 39*c* raises the raisable portion 29*c* and passes below a bottom side of the engagement arm section 27*a*, 27*b* when each projection 39*b*, 39*c* moves to the front end portion of the bottom surface section 25*a* from the lower area of the guide groove 34. Under the condition, the slide pin 37 disengages from the engagement recesses 29*b* of the engagement arm sections 27*a*, 27*b*.

The support unit 39 has a size that can pass, between the raisable portions 29*c* of the engagement arm sections 27*a*, 27*b*, between the guide piece units 35*a*, 35*b*, and through the guide opening 32*a*. Thus, the support unit 39 can be retracted onto the base member 25 within the storage space 22*b* together with the seat 21 by extending along the bottom surface of the seat 21. That is, the support unit 39 can be retracted between the bottom surface section 25*a* and the seat 21. Also, the support unit 39 can be positioned in the guide opening 32*a* under the condition that the support unit 39 can extend or contract in the vertical direction when the seat 21 is pulled out of the storage space 22*b*.

Because the seat structure 20 can be constructed as described above, the seat 21 can be retracted within the storage space 22*b* or can be pulled out of the storage space 22*b* in accordance with steerage conditions or preference of the rider. That is, when the rider needs to or desires to steer the small planing watercraft 10 while sitting on the seat 21, the rider can pull out the seat 21 from the inside of the hatch cover 22 and sets the support unit 39 in the supporting position, as shown in FIGS. 1 and 2.

Figure 11:
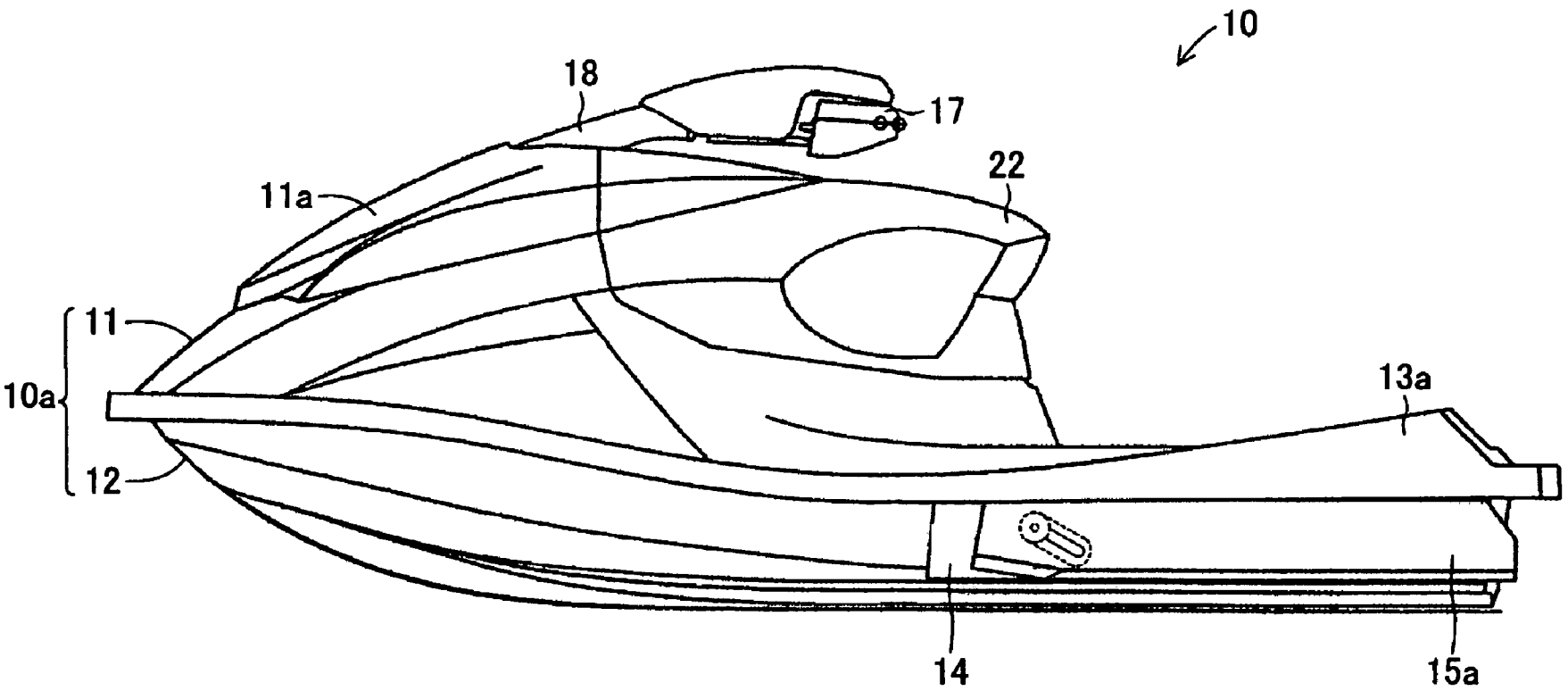
FIG. 11 is a side elevational view of the watercraft of FIG. 1 with the seat retracted into a storage compartment.
Figure 12:
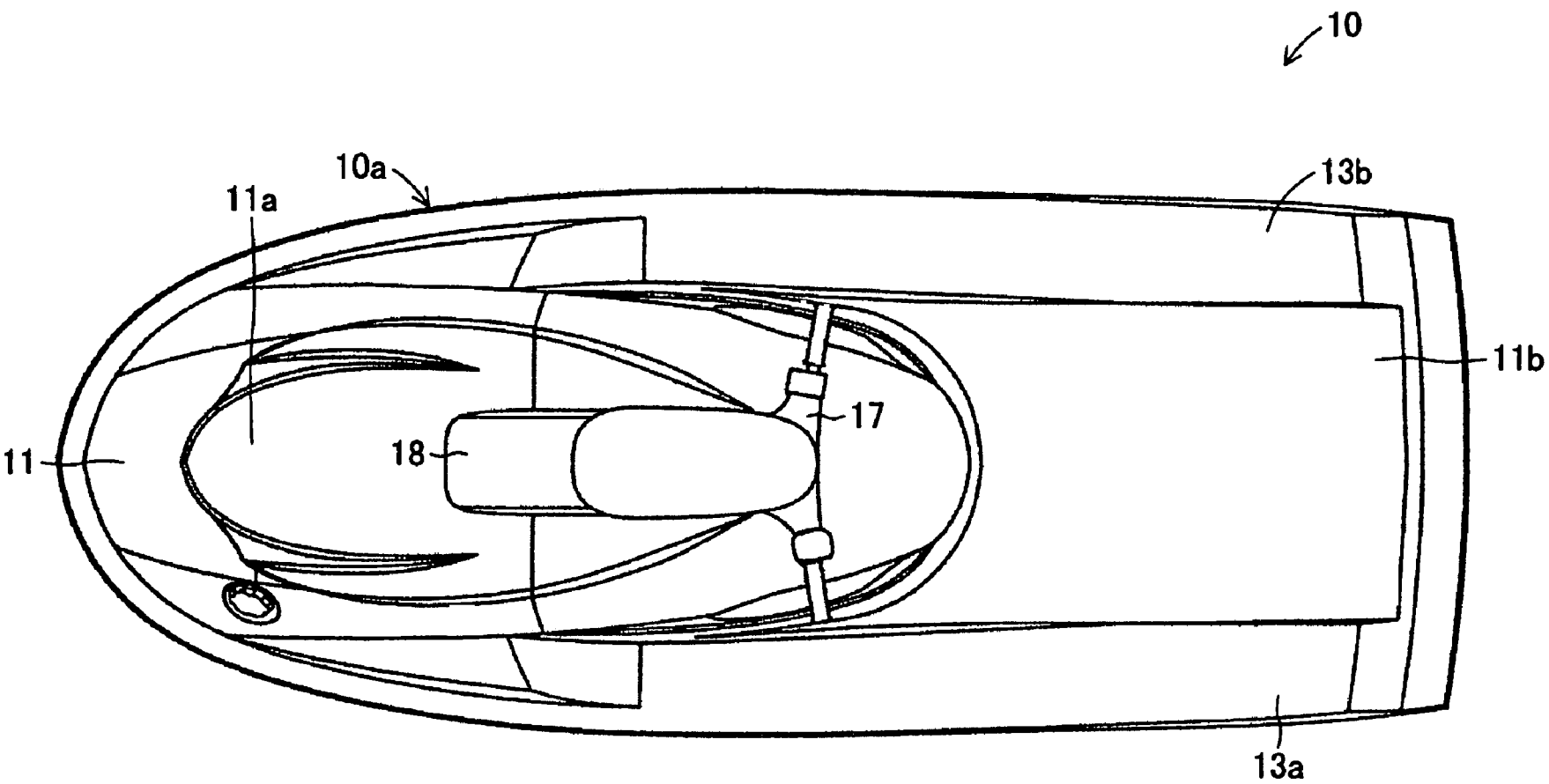
FIG. 12 is a top plan view of the small planing watercraft in the configuration shown in FIG. 11.

When the rider needs to or desires to steer the small planing watercraft 10 while standing on the floor section 11*b*, the rider can retract the seat 21 within the storage space 22*b* as shown in FIGS. 11 and 12. Also, the hatch cover 22 can be pivotable about an axis of a support shaft (not shown) that can be positioned at a rear bottom of the hatch cover 22. Thus, the top portion of the front deck section 11*a* can be opened by rotating the front portion of the hatch cover 22 rearward about the axis of the support shaft, under the condition that the connecting pole 18 extends upward. Thereby, the user or rider can perform maintenance work such as inspection, repairs or the like on components located within the hull 10*a*.

As shown in FIGS. 1 and 2, an engine 41 can be located in a center bottom space within the hull 10*a*. An air duct 42 can be disposed in a forward space of the hull 10*a* for introducing ambient air into the hull 10*a*. The air duct 42 can extend vertically to a bottom area of the hull 10*a* from a top area of the hull 10*a*. The air duct 42 thus can guide ambient air from its top end through a water-resistant structure of the front deck section 11*a* and introduce the air into a bottom area of the hull 10*a* from its bottom end. A fuel tank 43 can be also disposed in the forward space of the hull 10*a* for accumulating fuel.

An intake box 44 can be disposed between the engine 41 and the fuel tank 43 within the hull 10*a*. The intake box 44 supplies the air introduced into the inside of the hull 10*a* through the air duct 42 to the engine 41. Also, the fuel can be supplied to the engine 41 from the fuel tank 43. Any type of fuel delivery system can be used. In some embodiments, the fuel delivery system includes a fuel injection device (not shown) that is configured to spray the fuel supplied from the fuel tank 43 into cylinders of the engine. While sprayed, the fuel is mixed with the air supplied from the intake box 44 and is sent to the engine 41 as an air/fuel mixture. An ignition device of the engine 41 ignites the mixture for combustion.

A crankshaft (not shown) can extend rearwardly from a rear portion of the engine 41. The crankshaft converts a reciprocal movement of pistons (not shown) caused by the combustion of the mixtures to a rotational movement.

The crankshaft can be connected, to an impeller shaft (not shown). The impeller shaft can comprise a single shaft or a plurality of shafts connected together. The impeller shaft can be coupled with a jet propulsion device 45 mounted on the stern of the hull 10*a*.

An impeller (not shown) can be affixed to the impeller shaft within the jet propulsion device 45. The rotational power of the crankshaft made by the engine 41 thus can be transmitted to the impeller through the impeller shaft, thereby rotating the impeller and generating thrust for the watercraft 10.

The jet propulsion device 45 can have a water inlet 45*a* that opens at the bottom of the hull 10*a* and a discharge nozzle (not shown) that opens at the stern of the hull 10*a*. The jet propulsion device 45 can be configured to eject water through the discharge nozzle to generate propulsive power of the hull 10*a*.

The jet propulsion device 45 can be affixed to a bottom portion of the stern of the hull 10*a* such that a hull tunnel (not shown) isolates the device 45 from the body of the hull 10*a*. The impeller shaft penetrates the hull tunnel to extend to the jet propulsion device 45 from the engine 41.

A steering nozzle (not shown) can be attached to a rear portion of the discharge nozzle. Operational wires can be used to connect the steering nozzle with the steering handlebars 17 such that the steering nozzle is pivoted rightward or leftward in response to corresponding operations of the steering handlebars 17.

An exhaust device that includes exhaust conduits 46*a*, 46*b* and a water-lock 46*c* can be coupled with the engine 41. The exhaust conduit 46*a* transfers exhaust gases discharged from the engine 41 to the water-lock 46*c*.

The water-lock 46*c* can be in the configuration of a tank that has a large (wide) lower portion and a small (narrow) upper portion. However, this is merely one optional configuration for the water-lock 46*c*.

The exhaust conduit 46*a* can be connected to a lower side portion of the water-lock 46*c*, and the exhaust conduit 46*b* can be connected to a top surface of the water-lock 46*c*. The exhaust conduit 46*b* can be arranged to extend upwardly from the top surface of the water-lock 46*c* and to further extend rearwardly and downwardly. A downstream end of the exhaust conduit 46*b* can open at the hull tunnel that isolates the jet propulsion device 45 from the body of the hull 10*a* and communicates outside from a rear end portion of the hull 10*a*.

The small planing watercraft 10 can also have, other than the devices described above, electrical control devices such as a CPU, a ROM, a RAM, a timer and so forth, electric component boxes accommodating various electrical components or devices, and various devices, such as various sensors or switches, that are useful for operation of the small planing watercraft 10.

Operations for running the small planing watercraft 10 that is constructed as described above is further described below. For example, if a rider wishes to operate the small planing watercraft 10 while sitting on the seat 21, the rider can pull out the seat 21 from the inside of the hatch cover 22 and set the support unit 39 to support the seat 21.

Figure 13:
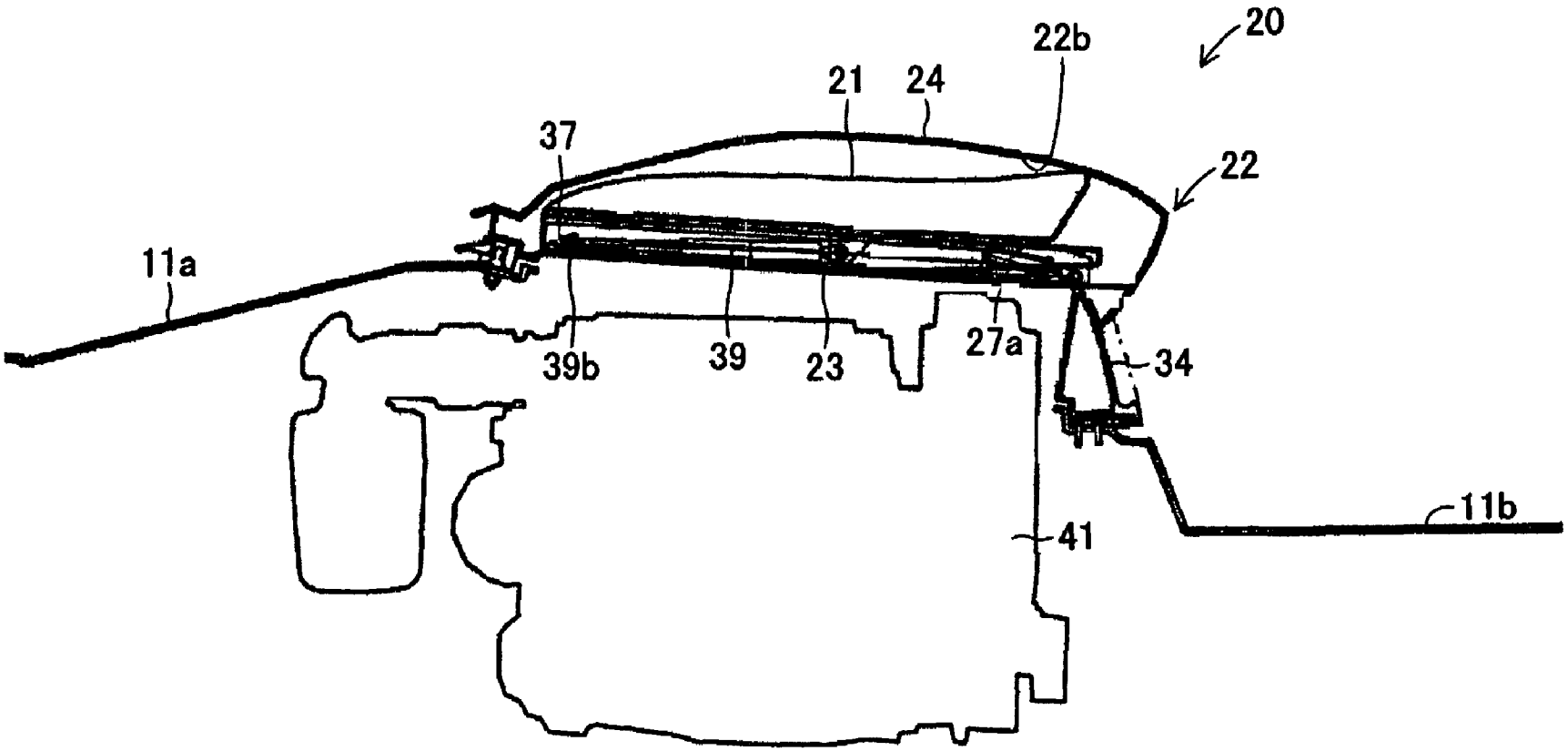
FIG. 13 is a schematic partial side elevational and cross-sectional view of the watercraft in the configuration shown in FIG. 11.
Figure 14:
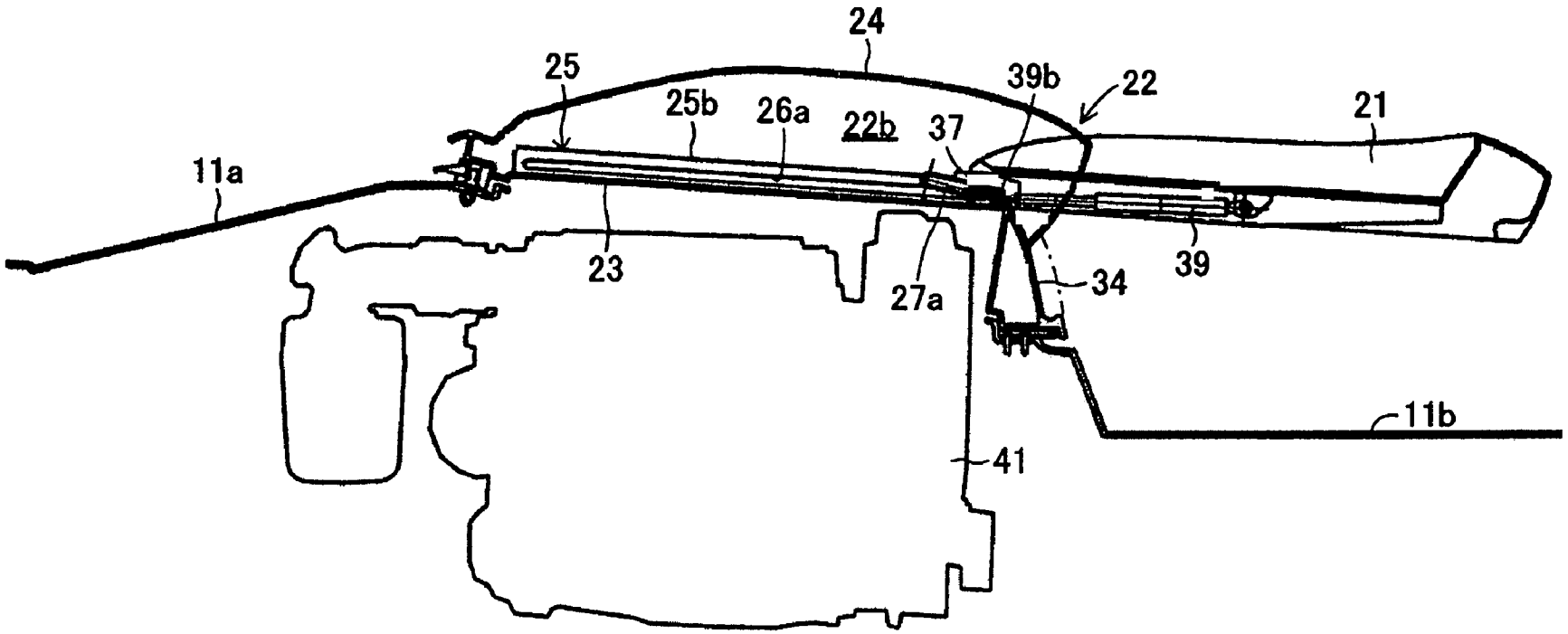
FIG. 14 is a schematic partial side elevational and cross-sectional view of the watercraft shown in FIG. 11, with the seat extended rearwardly.

This operation begins with the seat 21 being retracted inside of the hatch cover 22 as shown in FIG. 13. Then the seat 21 is pulled rearwardly from the hatch cover 22, as shown in FIG. 14. While the seat 21 is moved, the slide pin 37 engages with the recesses 29*b* of the respective arm sections 27*a*, 27*b*, while the projections 39*b*, 39*c* of the support unit 39 stay above the rear end portion of the bottom surface section 25*a*.

Figure 15:
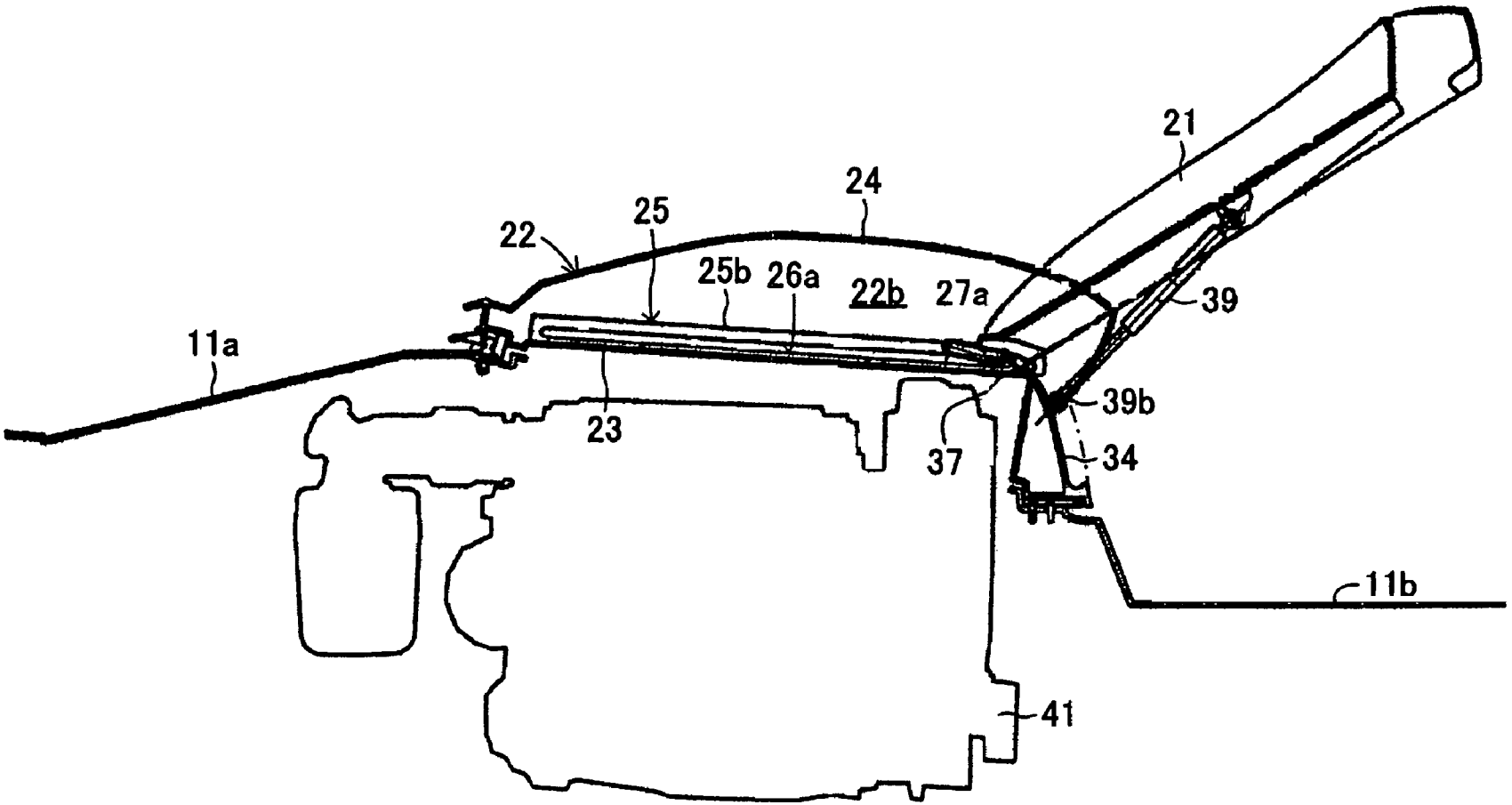
FIG. 15 is a schematic partial side elevational and cross-sectional view of the watercraft shown in FIG. 11 with a rear portion of the seat lifted upwardly.

Next, as shown in FIG. 15, the rider lifts the rear end portion of the seat 21 to set a slant angle of the seat 21 from the horizontal plane to a preset angle. The projections 39*b*, 39*c* can move to the guide groove 34 from the bottom surface section 25*a* when the slant angle of the seat 21 equals to the preset angle.

In this state, the projections 39*b*, 39*c* are placed at the positions indicated by the double dotted chain line circle A of FIG. 9. Thereby, the projections 39*b*, 39*c* of the support unit 39 can be pulled rearward and move to the guide surface section 31*a* from the bottom surface section 25*a*.

Then, the rider can release the rear end portion of the seat 21 to allow the seat 21 to move downwardly. The seat 21 thus changes to the condition shown in FIG. 15A. On the way to this condition of the seat 21, the projections 39*b*, 39*c* descend along the guide surface section 31*a* and engage with the bottom end portion of the guide groove 34 (i.e., the bottom end portion of the wall section 31*b*). The center portion of the seat 21 thus can be supported by the support unit 39.

Figure 15A:
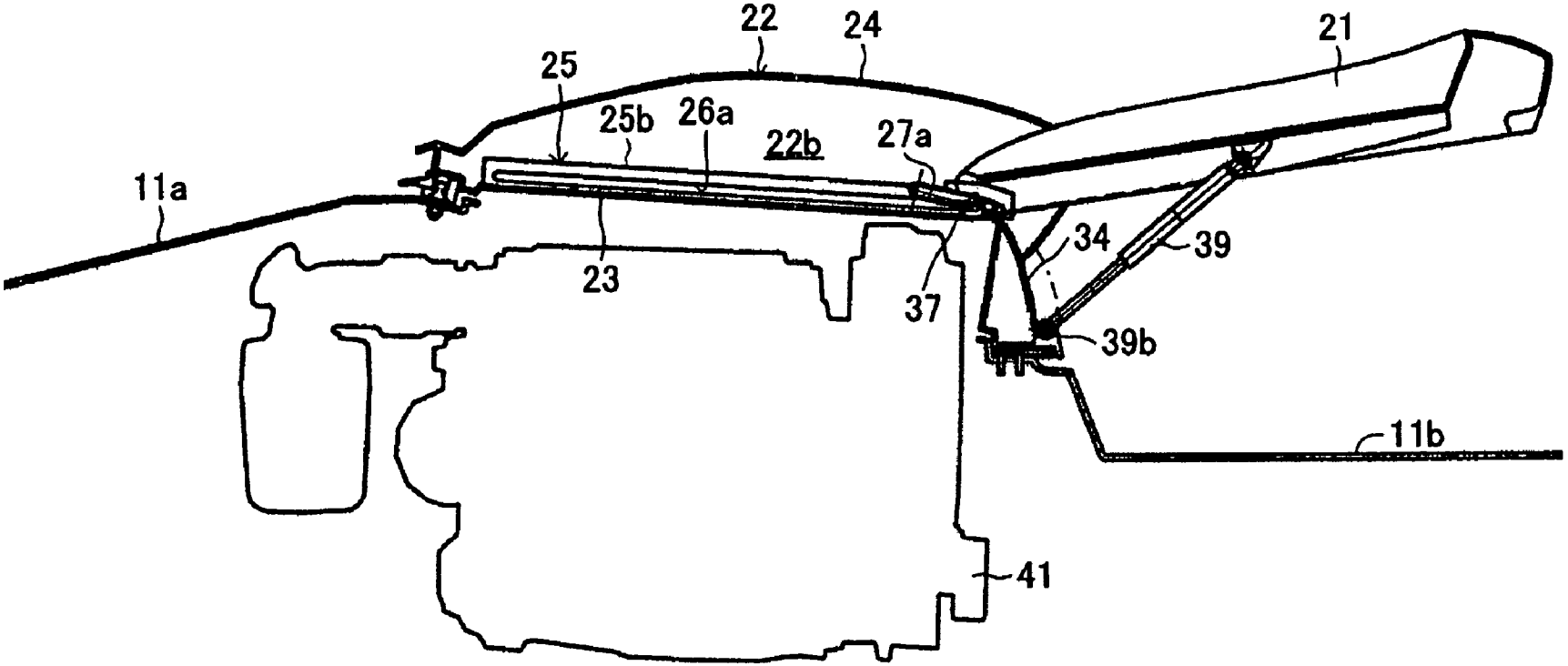
FIG. 15A is a schematic partial side elevational and cross-sectional view of the watercraft shown in FIG. 1 with the seat is supported by a support unit.

In the orientation of shown in FIG. 15A, the rider sitting on the seat 21 can hold the handling grips 17*a*. The rider can also activate a start switch (not shown) to set the small planing watercraft 10 to be ready for running. With the rider's operations of the steering handlebars 17 and throttle control members provided on one of the handling grips 17*a*, the small planing watercraft 10 can run in a desired direction and at a desired, speed corresponding to the operations.

Under the running condition, the rider can operate the lifting mechanism 16 to move the supplemental hull components 15*a*, 15*b* upward or downward. Thereby, the rider can achieve additional adjustments of the handling characteristics of the hull 10*a* as he or she desires. Additionally, through other operations, the connecting pole 18 can be positioned at the front end of its movable range by engaging the support shaft 18*a* and the support shaft engagement with recess 53*a* with each other.

Under the circumstances described above, if the rider desires to run the small planing watercraft 10 while standing on the floor section 11*b* without the seat being in the way, the rider can first lift the rear portion of the seat 21 to change the condition of the seat 21 shown in FIG. 15A to a condition similar to the condition shown in FIG. 15. Thereby, the seat 21 pivots about the axis of the slide pin 37, and the projections 39*b*, 39*c* of the support unit 39 passes between the swingable pieces 36*b* of the respective guide piece units 35*a*, 35*b* and the guide opening forming section 32 to ascend within the guide groove 34.

Afterwards, the slant angle of the seat 21 becomes a preset angle for its retraction. This preset angle can be slightly larger than the preset angle for the extension. Also, the projections 39*b*, 39*c* can move to the bottom surface section 25*a* from the guide groove 34 without descending when the seat can be positioned at this preset angle. The double dotted chain line circle B of FIG. 9 indicates positions of the projections 39*b*, 39*c* in this state. The rider releases the rear portion of the seat 21 to allow the seat 21 to be in the position of FIG. 14, when the slant angle of the seat 21 becomes the preset angle for the retraction and the projections 39*b*, 39*c* ascend to reach their preset positions.

On this occasion, the projections 39*b*, 39*c* are prevented from descending by the fixed pieces 36*a* of the guide piece units 35*a*, 35*b* and move to the bottom surface section 25*a*. The projections 39*b*, 39*c* then raise the raisable portion 29*c* of the respective engagement with arm sections 27*a*, 27*b* and disengage the slide pin 37 from the engagement with recess 29*b* of the respective engagement with arm sections 27*a*, 27*b*, as shown in FIG. 10. In this state, the support unit 39 extends along the bottom surface of the seat 21. The rider, next, pushes the seat 21 forward to set it to the condition shown in FIG. 13. Thereby, the seat 21 and the support unit 39 are housed within the storage space 22*b*.

Also, the rider can lift up the steering handlebars 17 to disengage the support shaft 18*a* from the support shaft engagement with recess 53*a* and pulls the steering handlebars 17 rearward. The steering handlebars 17 thus moves to the upper rear portion along a locus indicated by the one dotted chain line "a" of FIG. 3. That is, under the condition, the support shaft 18*a* can be positioned at the rear end portion 53*b* of the support shaft slide groove 53, and the guide shaft 18*b* engages with the guide shaft engagement with recess 55*b*. Thus, when the rider stands on the floor section 11*b* and takes hold of the steering handlebars 17 while pushing it downward, the connecting pole 18 can be maintained in this state. The rider can easily control the hull 10*a* while standing, accordingly.

Further, if the rider desires to actively steer the small planing watercraft 10 under the standing condition on the floor section 11*b*, such as, for example, to turn the hull 10*a* while moving the steering handlebars 17 up and down, the rider can pull the steering handle 17 rearwardly while lifting it up. Thereby, the guide shaft 18*b* disengages from the guide shaft engagement with recess 55*b* and becomes ready to move along the arcuate groove section 55. The steering handle 17 thus can move along the locus indicated by the one dotted chain line "b" of FIG. 3.

Under the condition that the guide shaft 18*b* can be positioned in the arcuate groove 55, the lever 56 and the spring 57 together urge the guide shaft 18*b* upward. Thus, all the rider needs to do is to softly move the steering handlebars 17 up and down to move the steering handle 17 along the locus indicated by the one dotted chain line "b" of FIG. 3. The rider, therefore, can perform turns while moving the steering handlebars 17 in the standing position on the floor section 11*b*.

As thus described, in connection with the small planing watercraft 10 of this embodiment; if the rider desires to steer while sitting on the seat 21, the rider can extend the seat 21 rearward from the hatch cover 22. If the rider desires to steer it while standing, the rider can retract the seat 21 within the storage space 22*b*. Thus, the rider can choose to steer the watercraft 10 in the sitting position or the standing position.

To extend the seat 21, the rider can simply pull the rear end portion of the seat 21 rearwardly with only one hand, and then can and release the seat 21 after lifting the seat 21 to the preset angle. Also, to retract the seat, it is only required to simply lift the rear end portion of the seat 21 upwardly, with only one or both hands if desired, and to push the seat 21 forward while keeping it horizontal. Thus, the extension and the retraction of the seat 21 can be quite easily performed.

The seat structure also does not detract from the external appearance of the watercraft, because the rear end surface of the seat 21 can be flush with the hatch cover 22 when the seat 21 is retracted within the storage space 22*b*. As such, the rear end surface of the hatch cover 22 has no irregularities. Also, the seat 21 can be maintained in a stable condition when the seat 21 is pulled out rearwardly from the hatch cover 22, because the front end portion of the seat 21 can be supported by the rear end portion of the base member 25 and the generally center portion of the seat 21 can be supported by the support unit 39. The rider thus can steer the craft in a stable, seated position.

The height of the rear portion of the seat 21 can be adjusted to accommodate the physique of the rider. For example, the length of the support unit 39 can be adjustable. Also, the storage space 22*b* can be made small because the support unit 39 can be folded when the seat 21 is retracted within the storage space 22*b*. Further, the ride comfort of the small planing watercraft 10 can be improved, because shocks can be absorbed by the dampers included with the support unit 39. The rider thus can enjoy comfortable planing. In addition, the seat 21 or the hull 10*a* is less likely to be damaged or harmed, because the impact load to the seat 21 or the hull 10*a* affected by the rider can be reduced by the shock absorbing function of the support unit 39.

The present seat structure is not limited to the embodiment described above. For example, in the above embodiment, the slide slots 26*a*, 26*b* work as the slide recess. The slide recess, however, can have any configuration for allowing the seat 21 to move in the fore aft direction, and thus can be formed with a groove or grooves. Also, a damper formed with a spring or other shock absorbing members can replace the gas damper described above. In addition, other structures or materials of the respective members or components that form the seat structure 20 or the small planing watercraft 10 are suitably changeable within the scope of the inventions disclosed herein.

Figure 16:
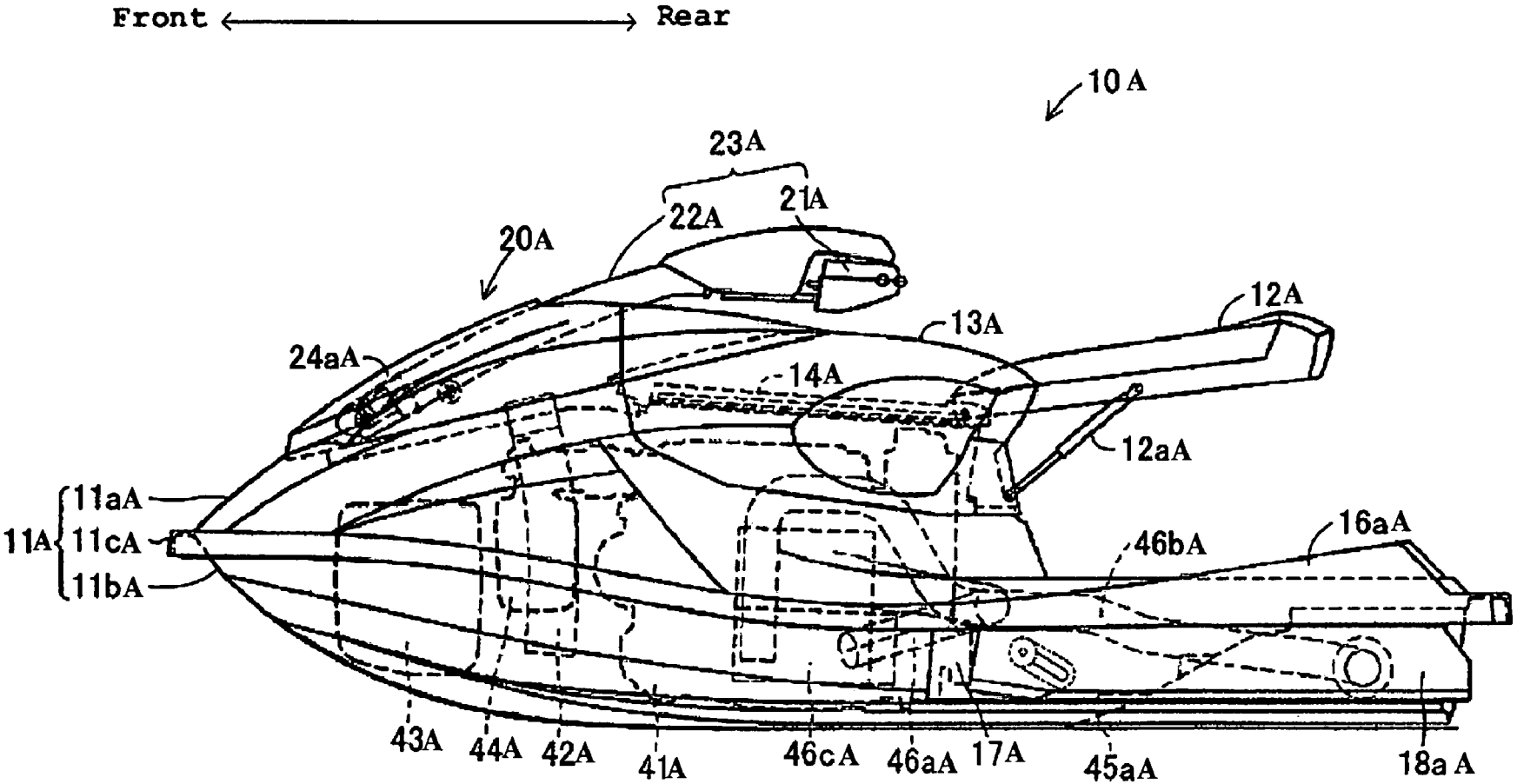
FIG. 16 is a side elevational view of a small planing craft that has a steering system configured in accordance with a first embodiment of the present invention.
Figure 17:
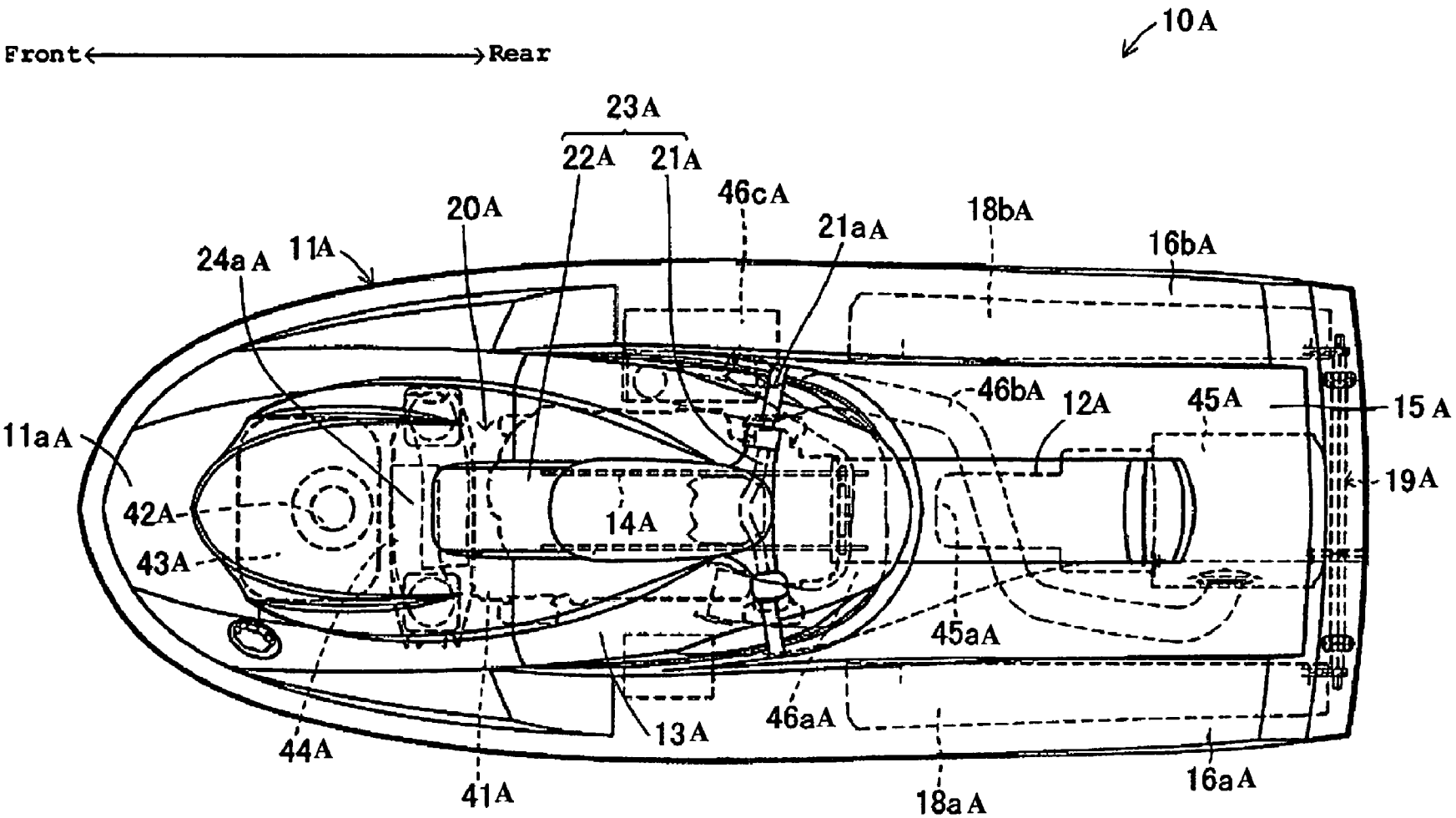
FIG. 17 is a top plan view of the small planing craft of FIG. 15.

Another embodiment is described below with reference to FIGS. 16-29. FIGS. 16 and 17 show a small planing craft 10A provided with a steering system 20A.

A hull 11A of the small planing craft 10A comprises a deck 11*a*A and a lower hull 11*b*A. The deck 11*a*A and the lower hull 11*b*A can have their peripheries jointed together in a watertight manner, forming a gunnel 11*c*A around the hull 11A.

Steering handlebars 21A can have handling grips 21*a*A disposed above the hull 11A at a generally center portion in the fore to aft direction thereof. A seat 12A can be disposed in the rear of the steering handlebars 21A.

The steering handlebars 21A can be included in the steering system 20A, discussed in greater detail below, and can be coupled with the hull 11A through a connecting pole 22A. The connecting pole 22A can be movable to a forward portion of the deck 11*a*A in the fore to aft direction and can also be mounted pivotably about an axis at the fore end in the vertical direction. Also, the steering handlebars 21A can be coupled with a rear end of the connecting pole 22A for pivotal movement in the right or left direction about an axis at the rear end of the connecting pole 22A. The steering handlebars 21A and the connecting pole 22A together form a steering pole 23A.

Figure 18:
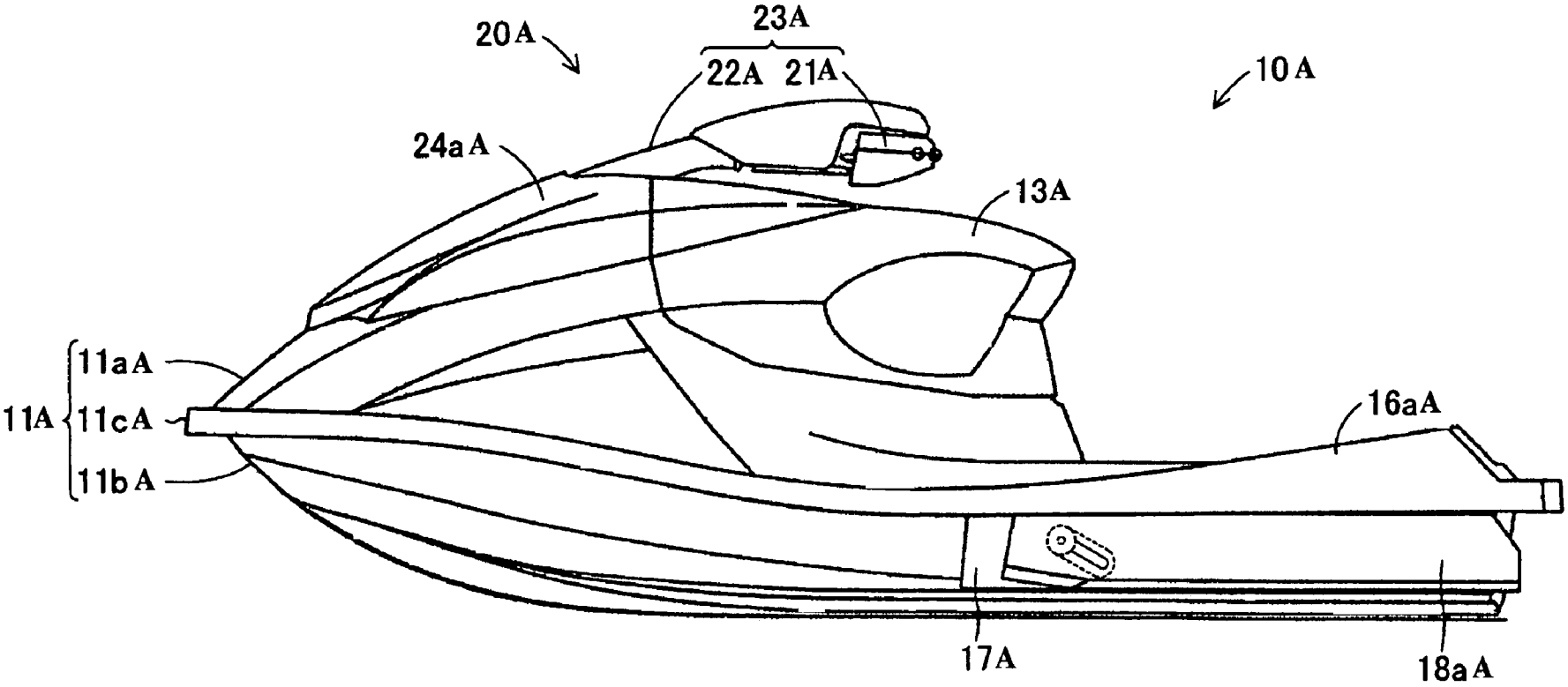
FIG. 18 is a side elevational view showing a condition under which a seat of the small planing craft of FIG. 15 is retracted within a hull.
Figure 19:
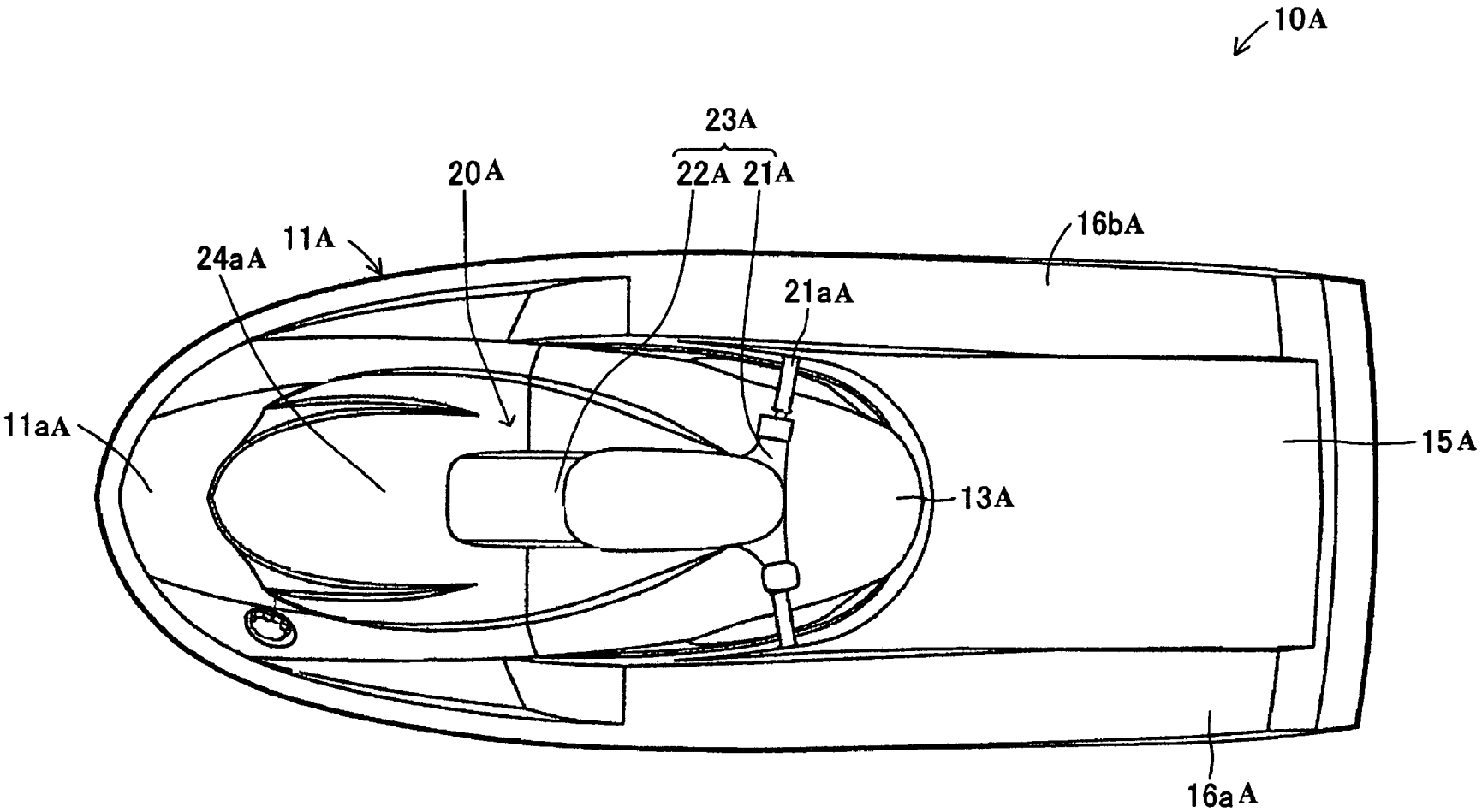
FIG. 19 is a top plan view of the small planing craft of FIG. 18.

The seat 12A can be extended from or be retracted into a hatch cover 13A, which is formed above the center portion of the hull 11A in the fore to aft direction. When the rider needs to or desires to steer the small planing craft 10A while standing, the rider can retract the seat 12A on a rail 14A provided within the hatch cover 13A as shown in FIGS. 18 and 19. In addition, when the rider needs to or desires to steer the small planing craft 10A while sitting on the seat 12A, the rider can pull out the seat 12A from the inside of the hatch cover 13A and can set a support rod 12*a*A in the supporting position, as shown in FIGS. 16 and 17.

Also, the hatch cover 13A can be pivotable about an axis of a support shaft (not shown) that is positioned at a rear bottom of the hatch cover 13A. Thus, the top portion of the deck 11*a*A can be opened by rotating the hatch cover 13A about the axis of the support shaft, under the condition that the steering pole 23A extends upwardly. Thereby, the user or rider can perform maintenance, inspections, and/or repairs on components located within the hull 11A.

A rear portion of the hull 11A can have a recessed step 15A on which the rider can stand. Each of right and left ends of the step 15A can have a side wall 16*b*A, 16*a*A, respectively. A lower outer side of each side wall 16*a*A, 16*b*A can have an attachment aid recess 17A (the attachment aid recess for the side wall 16*b*A is not shown).

A supplemental hull component 18*a*A, 18*b*A can also be attached to each attachment aid recess 17A. Each supplemental hull component 18*a*A, 18*b*A can be placed so that its position is adjustable in a vertical direction by a lifting mechanism 19A that is formed with a rotationally driving device or the like.

Each supplemental hull component 18*a*A, 18*b*A can define a portion of a planing surface of the watercraft 10 A and can widen a chine width. Thus, stability of the small planing craft 10A improves. The chine width becomes small when the respective supplemental hull components 18*a*A, 18*b*A are positioned higher. Thus, the small planing craft 10A can have a larger bank angle during turning in this mode of operation.

In addition, the top surface of the deck 11*a*A can have a storage support section 24A that can be configured to receive a front end portion of the connecting pole 22A under a reciprocally movable condition and also can support it. The storage support section 24A, the steering pole 23A and the like can be considered as forming the steering system 20A, in some embodiments.

The storage support section 24A can be a box-like concave area, the rear end of which can be open. An outer surface 24*a*A of the deck 11*a*A can form a top surface of the storage support section 24A. A base portion 24*b*A of the deck 11*a*A can form a bottom surface of the section 24A. Also, brackets 25*a*A, 25*b*A, which can have a plate-like configuration, or other configurations, can form both side surfaces of the section 24A. Each bracket 25*a*A, 25*b*A can have a support shaft slide groove 26A and a guide shaft slide groove 27A (both slide grooves of the bracket 25*b*A are not shown).

Figure 20:
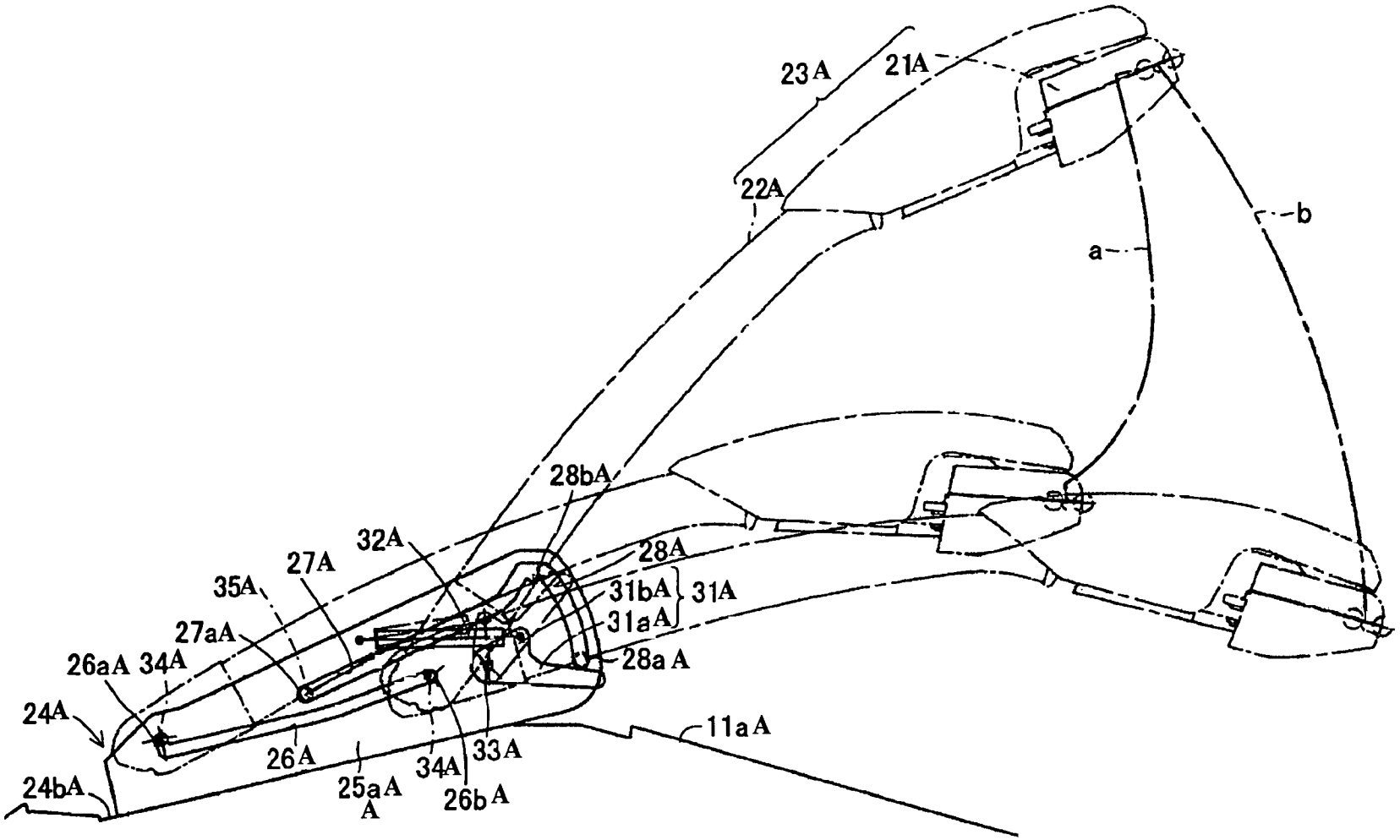
FIG. 20 is a side elevational view of the steering system.
Figure 21:
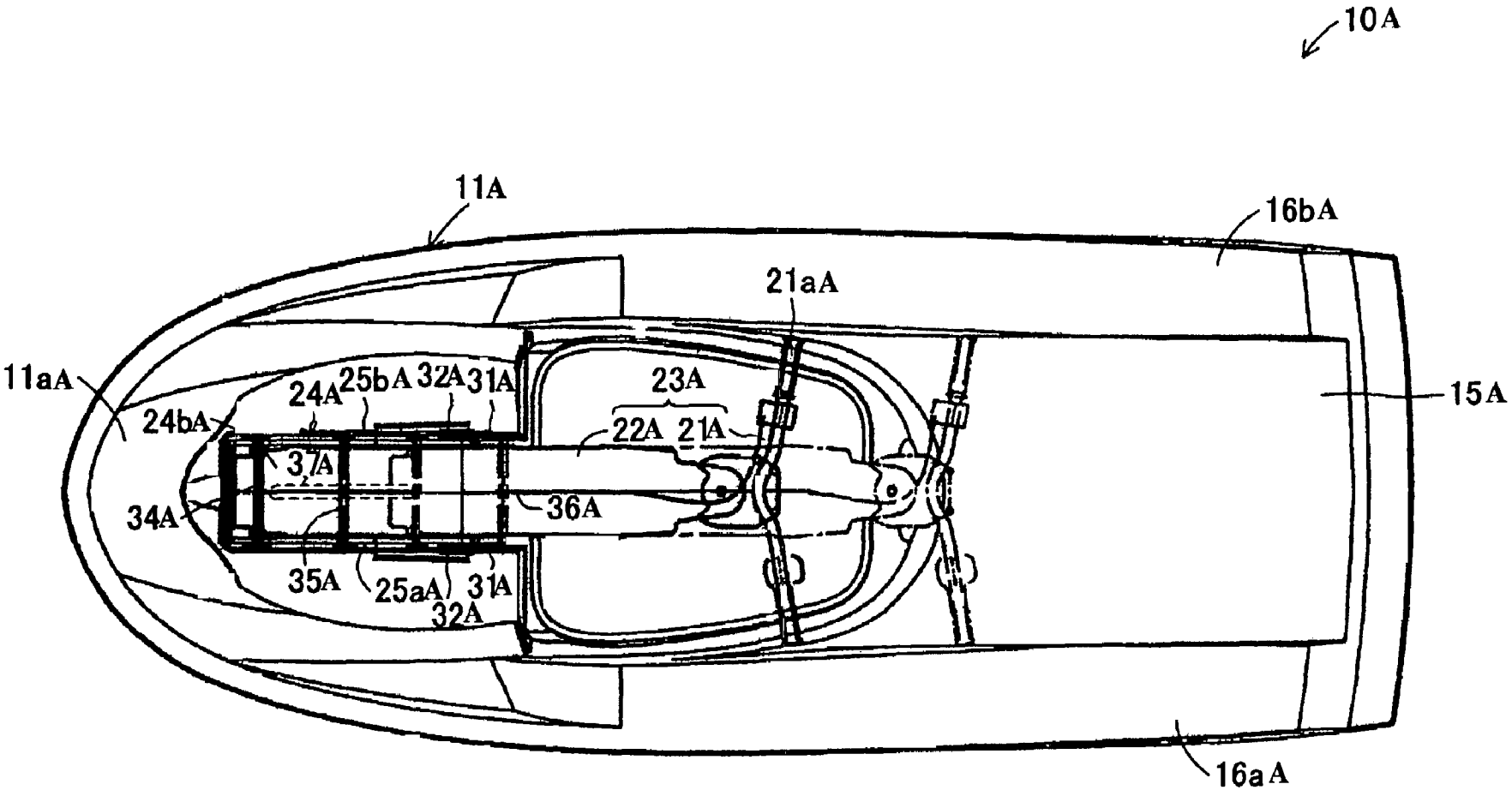
FIG. 21 is a top plan view showing the states in which a steering pole moves in the fore to aft direction.

With continued reference to FIG. 20, each support shaft slide groove 26A can be a slot that extends along a slope of the base portion 24*b*A of the deck 11*a*A and that slopes slightly upwardly toward its rear end from its front end. A slope angle of a rear portion of the slot is preferably larger than a slope angle of a front portion thereof.

An upper forward edge of the support shaft slide groove 26A can have a support shaft engagement recess 26*a*A. The support shaft engagement recess 26*a*A can extend upwardly with a width that can be the same as that of the support shaft slide groove 26A. Preferably, a configuration of a top end of the recess 26*a*A can be generally a semi-circle in a side view. However, other non-circular shapes can also be used.

Each guide shaft slide groove 27A can be a slot positioned above and in the rear of the support shaft slide groove 26A of each bracket 25*a*A, 25*b*A. Each guide shaft slide groove 27A can extend upwardly and rearwardly from a location generally above a center portion of the support shaft slide groove 26A, and its rear portion can be formed with an arcuate groove section 28A. A slope angle of a front portion of the guide shaft slide groove 27A can be larger than the slope angle of the rear portion of the support shaft slide groove 26A. A rear end of the front end portion of the guide shaft slide groove 27A can curve upwardly and can communicate with the arcuate groove section 28A in the rear of the curve.

The arcuate groove section 28A can be arcuately formed with its center of curvature positioned at a rear end 26*b*A of the support shaft slide groove 26A. Preferably, the height of a bottom end 28*a*A of the arcuate groove section 28A can be generally equal to the height of the rear end 26*b*A of the support shaft slide groove 26A.

The arcuate groove section 28A can have a guide shaft engagement recess 28*b*A at a lower edge of its portion where the rear end of the front end portion of the guide shaft slide groove 27A intersects a top end of the arcuate groove section 28A. Preferably, a configuration of the guide shaft engagement recess 28*b*A can be generally a semi-circle in a side view. However, other configurations can also be used.

A lever 31A and a spring 32A, which can form biasing means, can be attached to an outer surface of each bracket 25*a*A, 25*b*A. Each lever 31A generally has a hook shape that has a long leg 31*a*A and a short leg 31*b*A.

A pivot shaft 33A can support a base end of the lever 31A for pivotal movement. The spring 32A can extend between a top end of the short leg 31*b*A and a generally center portion of a top outer surface of each bracket 25*a*A, 25*b*A to urge the long leg 31*a*A of the associated lever 31A upwardly. The long leg 31*a*A can extend to a rear portion of the arcuate groove section 28A so that a rear end (top end) of the spring 32A reaches the position of the guide shaft engagement recess 28*b*A when the spring 32A shrinks to its minimum length.

The front end of the connecting pole 22A can have an aperture extending transversely. The support shaft 34A can extend through the aperture. Both ends of the support shaft 34A can protrude beyond respective side surfaces of the connecting pole 22A and enter the respective support shaft slide grooves 26A.

The guide shaft 35A can be fixed to a lower portion of the connecting pole 22A located in the rear of the support shaft 34A. Both ends of the guide shaft 35A can extend to enter the respective guide shaft slide grooves 27A.

Preferably, the guide shaft 35A is positioned at a front end 27*a*A of the guide shaft slide groove 27A when the support shaft 34A is positioned at a front end of the support shaft slide groove 26A. On the other hand, the guide shaft 35A can be positioned at the arcuate groove section 28A when the support shaft 34A is positioned at a rear end 26*b*A thereof.

A cable 36A can extend through the inside of the connecting pole 22A. The cable 36A can be designed to connect the handlebars 21A and throttle control members provided on the steering handlebars 21A, and/or other control devices (not shown) to a controller (not shown) and the like, which are located on the watercraft 10A, for example, within the hull 11A.

Figure 22:
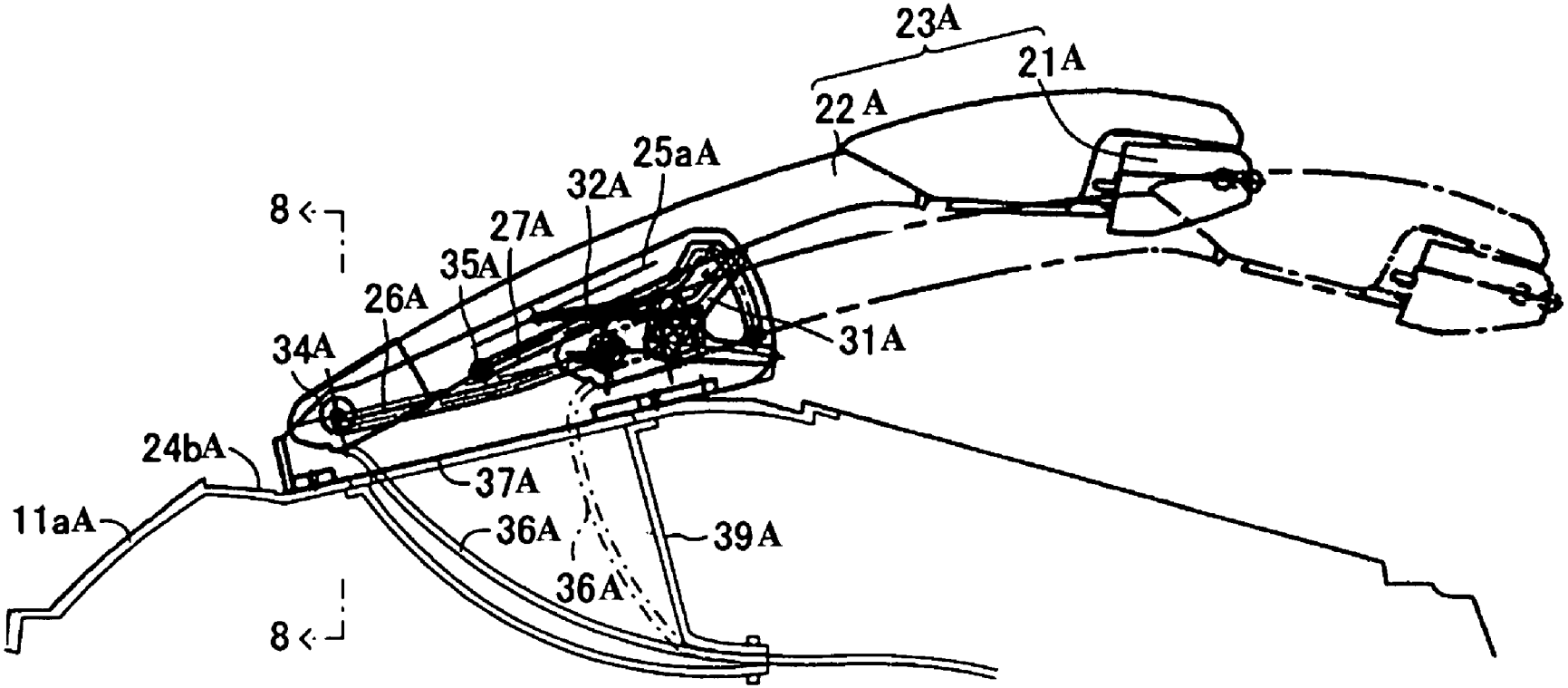
FIG. 22 is a side elevational view showing states in which the steering pole moves in the fore to aft direction.
Figure 23:
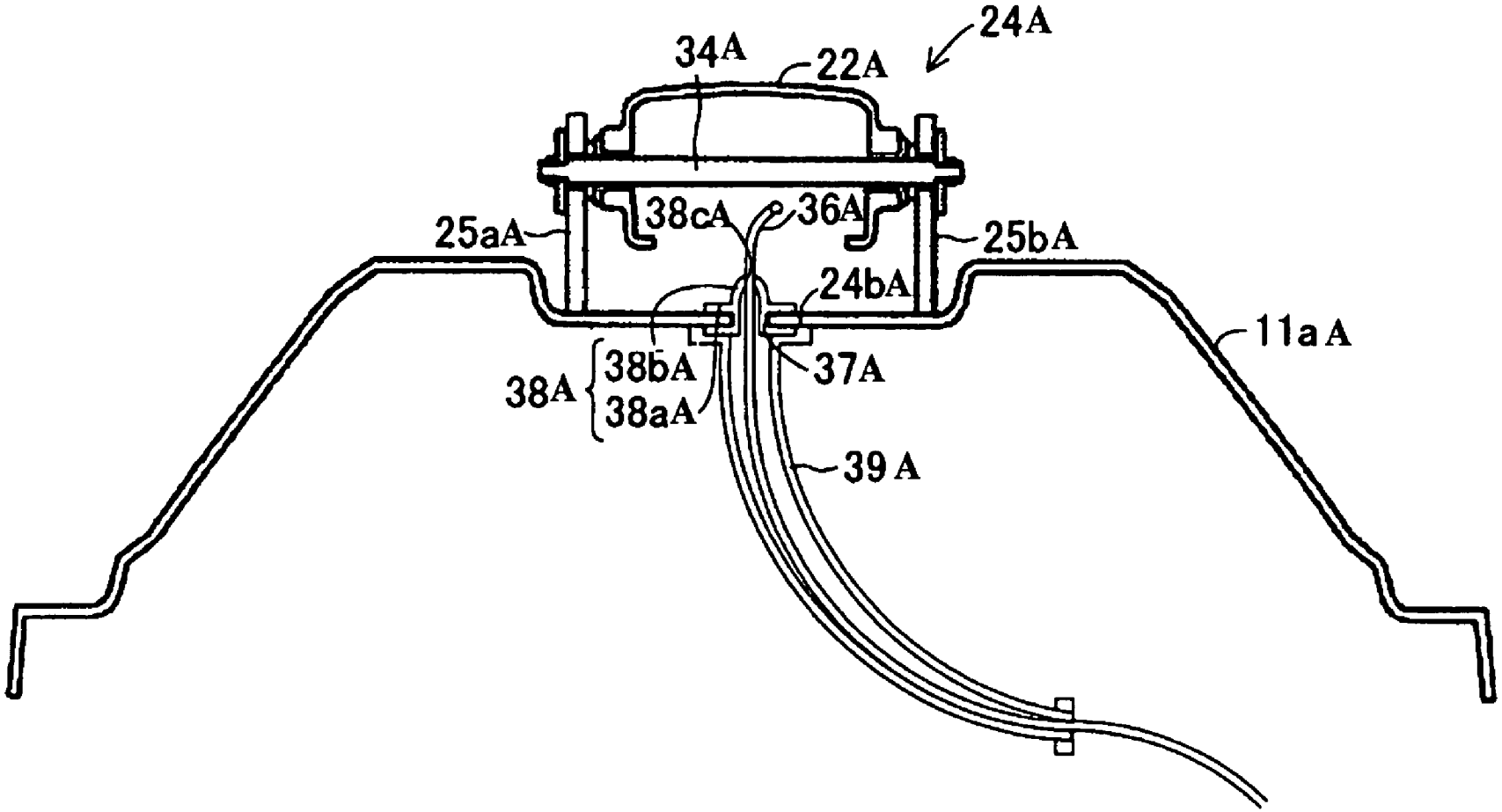
FIG. 23 is a sectional view taken along the line 8-8 of FIG. 22.
Figure 24:
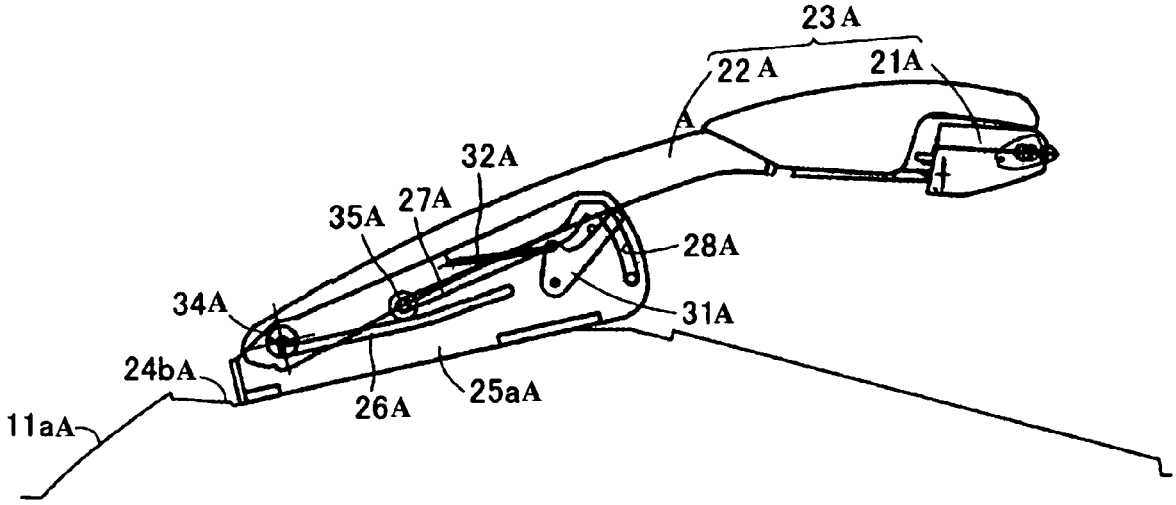
FIG. 24 is a side elevational view showing a state in which the steering pole is in the foremost position.

As shown in FIGS. 22 and 23, the cable 36A can extend through a cable slot 37A that can be formed on the base portion 24*b*A of the deck 11*a*A, and extends from the connecting pole 22A to the inside of the hull 11A. The cable slot 37A can be formed at a center portion between the brackets 25*a*A, 25*b*A on the base portion 24*b*A in the longitudinal direction of the brackets 25*a*A, 25*b*A. A rubber elastic seal 38A can be attached along the periphery of the cable slot 37A. A bag-shaped member 39A can be attached to the underside of the periphery of the cable slot 37A.

The elastic seal 38A can include a fixed portion 38*a*A, which can be attached along the periphery of the cable slot 37A to sandwich this periphery from above and below, and a seal portion 38*b*A protruding from the top surface of the fixed portion 38*a*A and curving upward. The top of the seal portion 38*b*A can have a gap 38*c*A formed in the longitudinal direction thereof. The cable 36A can move through the gap 38*c*A.

The bag-shaped member 39A can be formed into a bag shape, having an upper portion with its opening edge fixed to the underside of the periphery of the cable slot 37A in a watertight manner, and a lower portion whose width gradually becomes smaller toward the lower edge. The lower edge of the bag-shaped member 39A can be fixed to a given point of the cable 36A in a watertight manner. The length of the cable 36A, which can be arranged within the bag-shaped member 39A, can be preset such that the cable 36A can move in accordance with the movement of the steering pole 23A in the fore to aft direction.

Thus, when the steering pole 23A moves in the fore to aft direction, part of the cable 36A, which is arranged within the connecting pole 22A, and another part of the cable 36A, which is arranged below the bag-shaped member 39A, are maintained stationary relative to the connecting pole 22A and the hull 11A.

As shown in FIGS. 16 and 17, an engine 41A can be located in a center bottom space within the hull 11A. An air duct 42A can be disposed in a forward space of the hull 11A for introducing ambient air into the hull 11A.

The air duct 42A extends generally vertically to a bottom area of the hull 11A from a top area of the hull 11A. The air duct 42A allows ambient air flow into and out of a bottom area of the hull 11A from its bottom end. Optionally, the air duct 42A can include a water preclusion device (not shown), such as for example, but without limitation, a check valve or any other device configured to inhibit prevent water from entering the hull 11A. A fuel tank 43A can be also disposed in the forward space of the hull 11A for accumulating fuel.

An intake box 44A can be disposed between the engine 41A and the fuel tank 43A within the hull 11A, or any other location. The intake box 44A can be configured to guide the air introduced into the inside of the hull 11A through the air duct 42A to the engine 41A. Also, the fuel can be supplied to the engine 41A from the fuel tank 43A.

The fuel supplied from the fuel tank 43A can be atomized and sprayed by a fuel injector (not shown) to each cylinder of the engine 41A. While sprayed, the fuel can be mixed with the air supplied from the intake box 44A and can be sent to the engine 41A as a mixture. An ignition device of the engine 41A ignites the mixture for combustion.

A crankshaft (not shown) can extend rearwardly from a rear portion of the engine 41A. The crankshaft converts a reciprocal movement of pistons (not shown) caused by the combustion of the mixtures to a rotational movement. The crankshaft can be connected to an impeller shaft (not shown), and the impeller shaft can be coupled with a jet propulsion device 45A mounted on the stern of the hull 11A. An impeller (not shown) can be fixed to the impeller shaft within the jet propulsion device 45A. The rotational power of the crankshaft made by the engine 41A can be transmitted to the impeller through the impeller shaft. The impeller thus rotates and generates thrust for propelling the watercraft 10A.

The jet propulsion device 45A can have a water inlet 45*a*A that opens at the bottom of the hull 11A and an output nozzle (not shown) that opens at the stern. The jet propulsion device 45A jets water that is introduced through the water inlet

45*a*A from the output nozzle by the rotation of the impeller to generate propulsive power of the hull 11A.

The jet propulsion device 45A can be mounted to a bottom portion of the stern of the hull 11A such that a casing (not shown) isolates the device 45A from the body of the hull 11A. The impeller shaft penetrates the casing to extend to the jet propulsion device 45A from the engine 41A.

A steering nozzle (not shown) can be attached to a rear portion of the output nozzle. The cable 36A and operational wires connect the steering nozzle with the steering handlebars 21A such that the steering nozzle can swing rightward or leftward in response to the operations of the steering handlebars 21A.

An exhaust device that includes exhaust conduits 46*a*A, 46*b*A and a water-lock 46*c*A can be coupled with the engine 41A. The exhaust conduit 46A can transfer exhaust gases discharged from the engine 41A to the water-lock 46*c*A. The water-lock 46*c*A can be a tank that has a wide lower portion and a narrow upper portion.

The exhaust conduit 46*a*A can be connected to a lower side portion of the water-lock 46*c*A, while the exhaust conduit 46*b*A can be connected to a top surface of the water-lock 46*c*A. The exhaust conduit 46*b*A extends upwardly from the top surface of the water-lock 46*c*A and further extends rearwardly and downwardly. A downstream end of the exhaust conduit 46*b*A opens at the casing that isolates the jet propulsion device 45A from the body of the hull 11A and communicates outside from a rear end portion of the hull 11A.

The small planing craft 10A also has, other than the devices described above, electrical control devices such as a CPU, a ROM, a RAM, a timer and so forth, electric component boxes accommodating various electrical components or devices, and various devices, such as various sensors or switches, for operation of the small planing craft 10A.

During operation, if the rider wishes to run the small planing craft 10A while sitting on the seat 12A, the rider can first pull out the seat 12A from the inside of the hatch cover 13A and set the support rod 12*a*A to support the seat 12A. The steering pole 23A can be placed in the foremost position, with the steering handlebars 21A pushed downwardly. This allows the support shaft 34A at the fore end of the connecting pole 22A to be engaged with the support shaft engagement recess 26*a*A in the support shaft slide groove 26A so that the steering pole 23A is in a fixed state. In this state, the guide shaft 35A can be positioned at the front end 27*a*A of the guide shaft slide groove 27A.

Next, the rider can hold the handling grips 21*a*A to sit on the seat 12A in the small planing craft 10A. The rider, then, turns on a start switch (not shown) to start the engine 41A. With the rider's operations of the steering handlebars 21A and throttle control members provided on one of the handling grips 21*a*A, the small planing craft 10A can run in a desired direction and at a desired speed corresponding to the rider's operations. Also, during such operation, the rider can operate the lifting mechanism 19A to move the supplemental hull components 18*a*A, 18*b*A upwardly or downwardly. Thereby, the rider can control the craft as he or she desires, for example, by changing the turning characteristics of the watercraft 10A.

Figure 25:
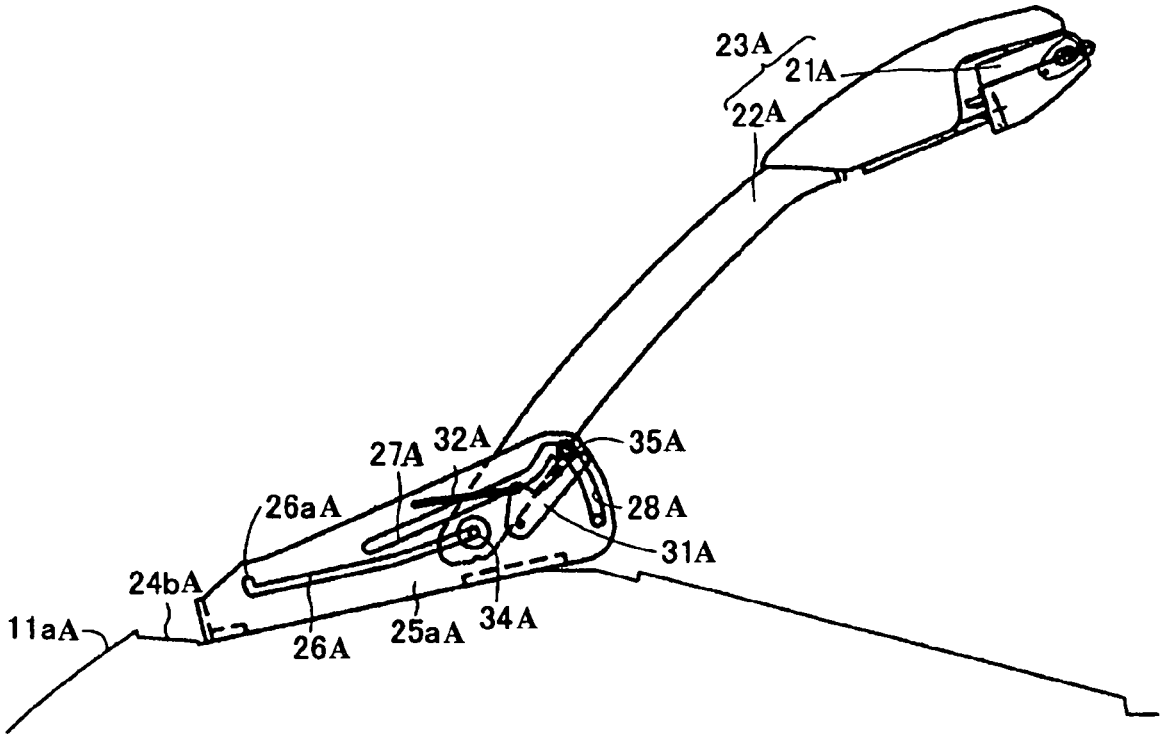
FIG. 25 is a side elevational view showing a state in which the steering pole is in the rearmost upper position.

Next, if the rider wishes to run the small planing craft 10A while standing on the step 15A, he or she can retract the support rod 12*a*A while pushing the seat 12A into the inside of the hatch cover 13A to accommodate the seat 12A on the rail 14A. Then, the rider can lift the steering handlebars 21A up to disengage the support shaft 34A from the support shaft engagement recess 26*a*A and pulls the steering pole 23A rearwardly. This allows the steering handlebars 21A to move along the locus indicated by the one dotted chain line "a" in FIG. 20, so that the steering pole 23A is positioned as shown in FIG. 25.

That is, under this condition, the support shaft 34A can be positioned at the rear end portion 26*b*A of the support shaft slide groove 26A, and the guide shaft 35A engages with the guide shaft engagement recess 28*b*A. Thus, when the rider who stands on the step 15A takes hold of the steering handlebars 21A while pushing it downward, the steering pole 23A can be maintained in a state shown in FIG. 25.

Figure 26:
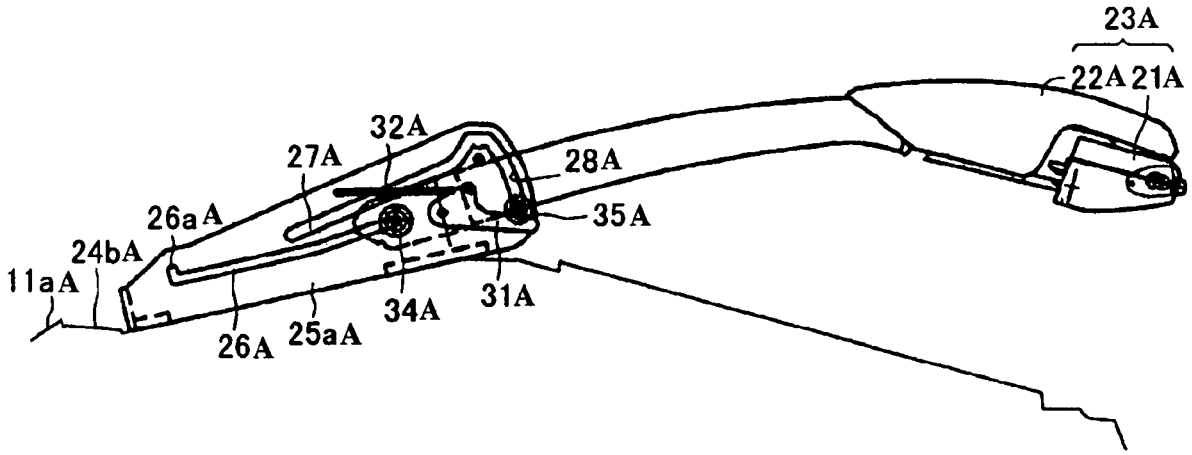
FIG. 26 is a side elevational view showing a state in which the steering pole is in the rearmost lower position.

Further, if the rider desires to actively steer the small planing craft 10A under the standing condition on the step 15A, such as, for example, to turn the craft while moving the steering pole 23A up and down, the rider can pull the steering pole 23A further rearwardly while lifting the steering handlebars 21A upwardly. Thereby, the guide shaft 35A disengages from the guide shaft engagement recess 28*b*A and becomes ready to move along the arcuate groove section 28A. This allows the steering handlebars 21A to move along the locus indicated by the one dotted chain line "b" in FIG. 20, so that the steering pole 23A is positioned as shown in FIG. 26 when the guide shaft 35A is positioned at the bottom end 28*a*A of the arcuate groove section 28A.

Under the condition that the guide shaft 35A is positioned in the arcuate groove 28A, the lever 31A and the spring 32A together urge the guide shaft 35A upwardly. Thus, all the rider needs to do is to softly move the steering handlebars 21A up and down to move the steering pole 23A in the range shown in FIGS. 25 and 26 (along the locus indicated by the one dotted chain line "b" in FIG. 20). The rider can therefore changing his or her steering position continuously as desired.

Equipped as such, a rider of the small planing craft 10A can reposition the steering pole 23A in accordance with his or her own physique, posture, and/or riding preferences. Thereby, the steerage of the small planing craft 10A can be easier and more comfortable for any rider in that the rider can select his or her preferable steering position.

When the steering pole 23A is in the foremost position, the support shaft 34A engages with the support shaft engagement recess 26*a*A, so that the steering pole 23A can be fixed. The rider can therefore steer the small planing craft 10A in a stable manner while sitting on the seat 12A. In turn, when the steering pole 23A is in the rearmost position, it can rotate about the axis of the support shaft 34A. Thereby, the rider can actively steer the small planing craft 10A while moving the steering handlebars 21A up and down.

The biasing means, which can include the lever 31A and the spring 32A, or can be formed from any other mechanical or electrical biasing mechanism, device, or system, can be provided to urge the steering pole 23A upwardly when the guide shaft 35A is positioned at the arcuate groove section 28A. This reduces the force required for the rider to operate the steering handlebars 21A. The rider can thus move the steering handlebars 21A up and down using little force.

The top end of the arcuate groove section 28A can be provided with the guide shaft engagement recess 28*b*A, or other device, which can be engaged with the guide shaft 35A. This allows the steering pole 23A to be in a fixed state as shown in FIG. 25 so that the rider standing on the step 15A can steer the small planing craft 10A without the steering pole 23A moving upwardly and downwardly.

As noted above, the cable slot 37A can be formed on the base portion 24A of the deck 11*a*A through which the cable 36A runs. The cable 36A can therefore move together with the steering pole 23A. This prevents the cable 36A from being strained and damaged. Since the elastic seal 38A having the gap 38*c*A can be attached along the periphery of the cable slot 37A, it prevents the water from entering inside of the hull 11A. The bag-shaped member 39A can be attached to the underside of the periphery of the cable slot 37A, through which the cable 36A runs. This prevents the water from entering inside of the hull 11A more reliably.

Figure 27:
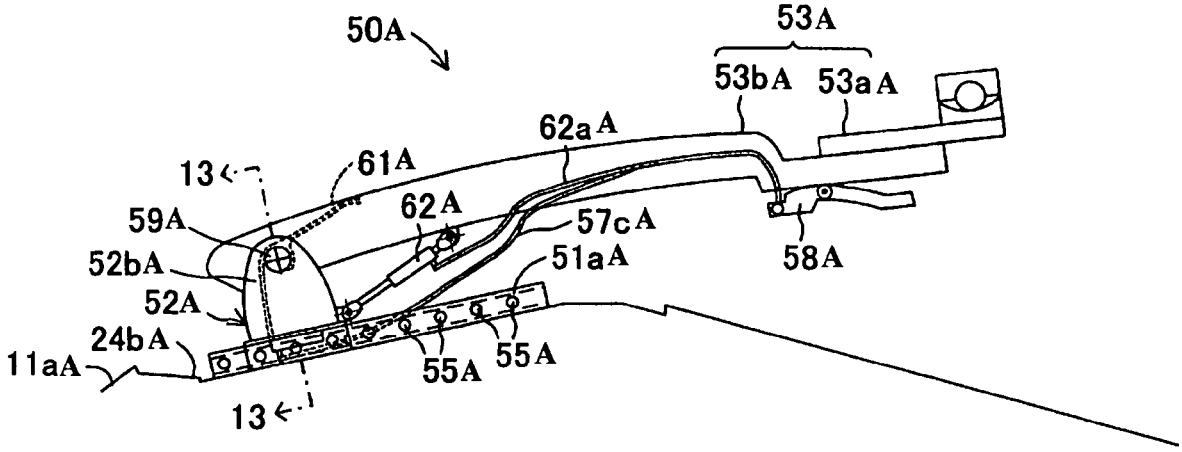
FIG. 27 is a side elevational view of the steering system configured in accordance with a second embodiment of the present invention.
Figure 28:
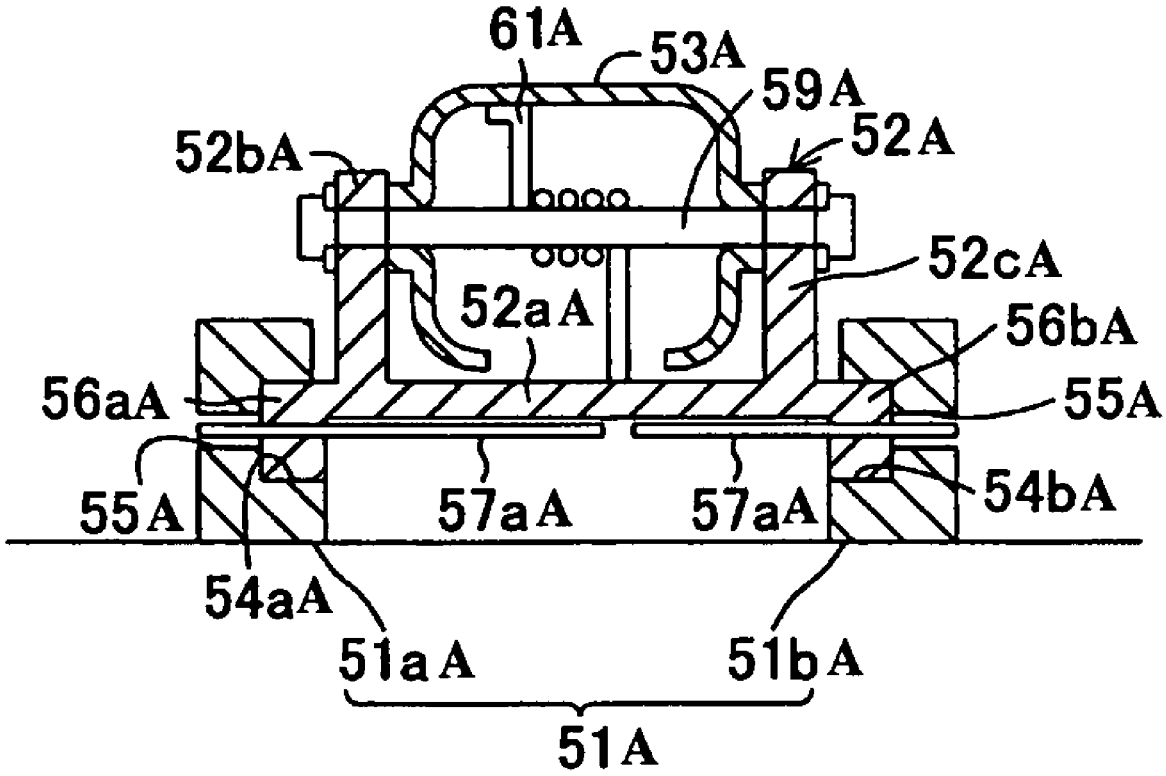
FIG. 28 is a sectional view taken along the line 13-13 of FIG. 27.
Figure 29:
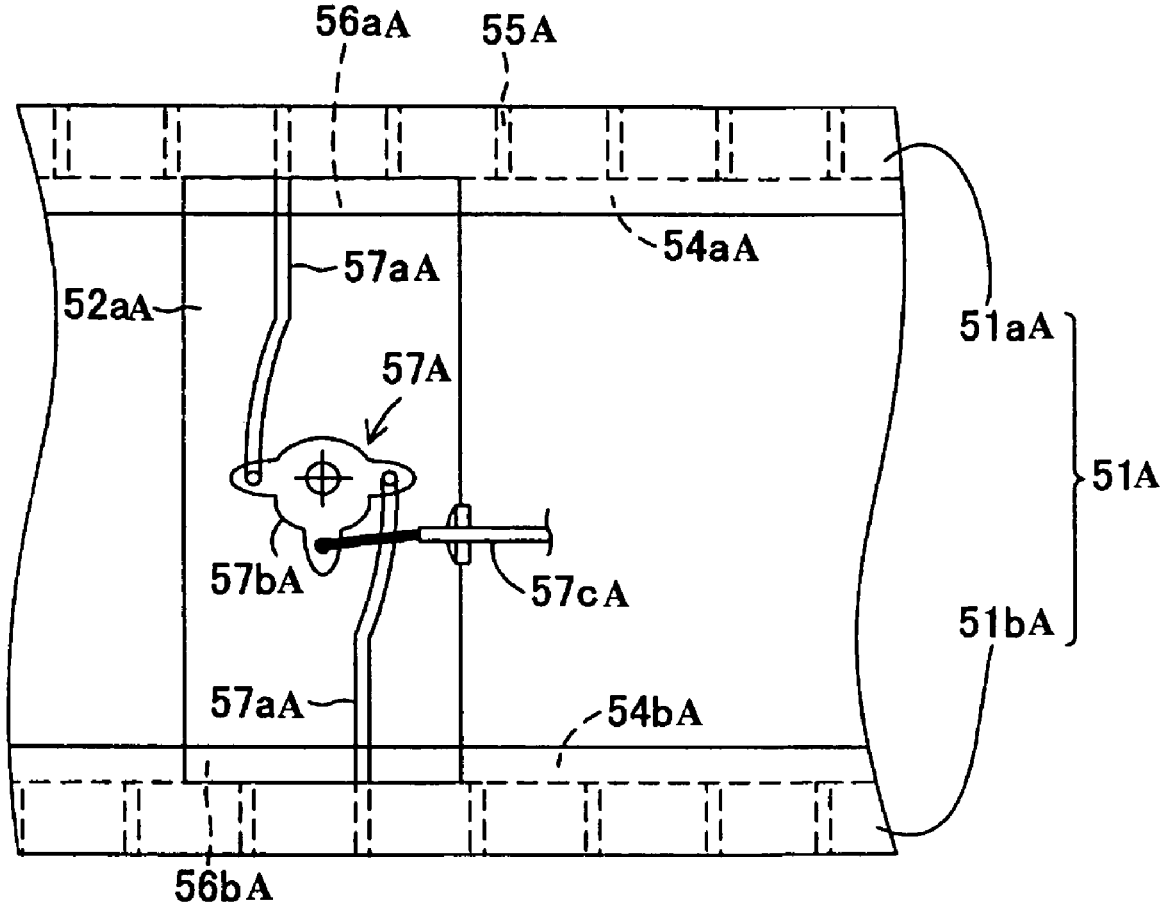
FIG. 29 is a bottom plan view of FIG. 27.

FIGS. 27 through 29 show another embodiment of a steering system, identified generally by the reference numeral 50A. The steering system 50A can include a rail part 51A, a bracket 52A movably mounted to the rail part 51A, and a steering pole 53A rotatably mounted to the bracket 52A, although other configurations and/or components can also be used.

The rail part 51A can have a pair of rails 51*a*A, 51*b*A on a base portion 24*b*A of a deck 11*a*A, which are arranged with a certain distance therebetween in the lateral direction, and extend in the fore to aft direction of the deck 11*a*A. Engagement recesses 54*a*A, 54*b*A can be formed on the sides where the rails 51*a*A, 51*b*A face to each other and in the longitudinal direction of the rails 51*a*A, 51*b*A. Each rail 51*a*A, 51*b*A can be provided with plural engagement holes 55A arranged at certain intervals in the fore and aft direction. Each engagement hole 55A protrudes through from one side to the other side of the rail 51*a*A, 51*b*A.

The bracket 52A can include, for example, but without limitation, a bottom surface 52*a*A and side surfaces 52*b*A52*c*A formed into generally triangle shapes and supporting a steering pole 53A from both sides. Engagement projections 56*a*A, 56*b*A can be formed on each edge of the bottom surface 52*a*A to movably engage with the engagement grooves 54*a*A, 54*b*A on the rails 51*a*A, 51*b*A, respectively. Each engagement projection 56*a*A, 56*b*A can have an aperture formed at its generally vertical center portion.

A pin 57*a*A of an engagement member 57A can be inserted through the aperture such that it can extend to or be retracted from the aperture. The rotation of a rotating portion 57*b*A allows the pin 57*a*A to extend to or be retracted from the aperture.

When the pin 57*a*A extends through the aperture, the pin 57*a*A engages with one of the engagement holes 55A on the rail 51*b*A, 51*b*A. Thus, the bracket 52A can be fixed to any given position of the rail 51A. The rotating portion 57*b*A can be connected via a push pull cable 57*c*A to a steering lever 58A mounted to steering handlebars 53*a*A. The rotating portion 57*b*A rotates through operations of the steering lever 58A so that the pin 57*a*A can extend to or be retracted from the aperture.

Each side surface 52*b*A, 52*c*A can have a support hole formed at its upper portion. A support shaft 59A or an engagement shaft, provided on the fore end of a connecting pole 53*b*A, can be rotatably mounted into the support holes. A torsion spring 61A, or another type offspring or biasing member, device, or mechanism, can be mounted to the support shaft 59A with one end of the torsion spring 61A can be fixed to the bottom surface 52*a*A of the bracket 52A and the other end in contact with the inner upper face of the connecting pole 53*b*A. As such, the torsion spring 61A urges the steering pole 53A upwardly.

A slope adjustor 62A, which can comprise a gas damper, extends between the rear bottom of the side surfaces 52*b*A, 52*c*A and the underside of the connecting pole 53*b*A at its generally center portion. The slope adjustor 62A can be connected to the steering lever 58A via a cable 62*a*A to extend or retract in accordance with operations of the steering lever 58A. Thus, the rider can set the slope angle of the steering pole 53A to any angle. However, other types of adjustment mechanisms can also be used which provide adjustment in a step-wise manner among a plurality of predetermined. Such step-wise mechanisms are also considered to allow the slope of the steering pole to be adjusted to any angle.

The steering lever 58A can include control members, respectively, for controlling the engagement member 57A and the slope adjustor 62A. The configuration of the small planing craft in FIG. 15 can be basically the same as the small planing craft 10A described above, except the steering system 50A and an area associated with the mounting of the steering system 50A.

With this configuration, each pin 57*a*A can be engaged with any one of engagement holes 55A on the rail 51*b*A, 51*b*A. The steering pole 53A can be positioned in any given point in the fore to aft direction. Adjusting the length of the slope adjustor 62A allows the slope angle of the steering pole 53A to be set to any angle. The length of the slope adjustor 62A may not be preset to a certain length while the slope adjustor 62A can be ready for free extension and retraction. The rider thus can steer the small planing craft by rotating the steering pole 53A upwardly and downwardly. Thus, the torsion spring 61A can urge the steering pole 53A upwardly, and thus the rider can easily steer the steering pole 53A. Other functions and effects of the steering system 50A can be the same or similar with those of the aforementioned embodiments.

The steering systems for the small planing watercraft described above are not limited to the specifically disclosed embodiments, but may be suitably changeable. For example, shapes of the support shaft slide groove 26A and the guide shaft slide groove 27A of are not limited to the aforementioned shapes, but may be suitably changeable for intended use. Further, one support shaft engagement recess 26*a*A and one guide shaft engagement recess 28*b*A are provided in the embodiments noted above. However, a plurality of such recesses and guide shaft engagement recesses may also be provided.

That is, the plural support shaft engagement recesses can be provided at certain intervals on the upper edge of the support shaft slide groove 26A while the plural guide shaft engagement recesses may be provided at certain intervals on the lower edge of the guide shaft slide groove 27A. Thereby, the steering pole 23A can be fixed to any given position in the fore to aft direction. Further, one each of the support shaft engagement recess and the guide shaft engagement recess may be formed in different positions, respectively, or a different number of support shaft engagement recesses and guide shaft engagement recesses may be formed in different positions, respectively as required. In addition, other structures or materials of the respective members or components that form the steering systems 20A, 50A or the small planing craft 10A are suitably changeable within the scope of the present invention.

FIGS. 30-38 show further embodiments of a small planing boat, identified generally by the reference numeral 10B. In this small planing boat 10B, a boat body 11B is formed of a deck 11*a*B and a hull 11*b*B, and peripheral portions of the deck 11*a*B and hull 11*b*B are joined together in a watertight manner so that a gunnel section 11*c*B is formed surrounding the boat body 11B. A steering handle 12B can be provided in the approximate center of the boat body 11B at the upper part. A seat 13B can be disposed behind the steering handle 12B.

The steering handle 12B can be connected to the boat body 11B through a connecting portion 12*b*B mounted for up and down rotation about a support shaft 12_a_B provided at the front of the deck 11_a_B. Thus, as in the above-noted embodiments, the steering handle 12B is rotatable up and down together with the connecting portion 12_b_B and also rotatable to the left or the right with respect to the rear end of the connecting portion 12_b_B.

Figure 30:
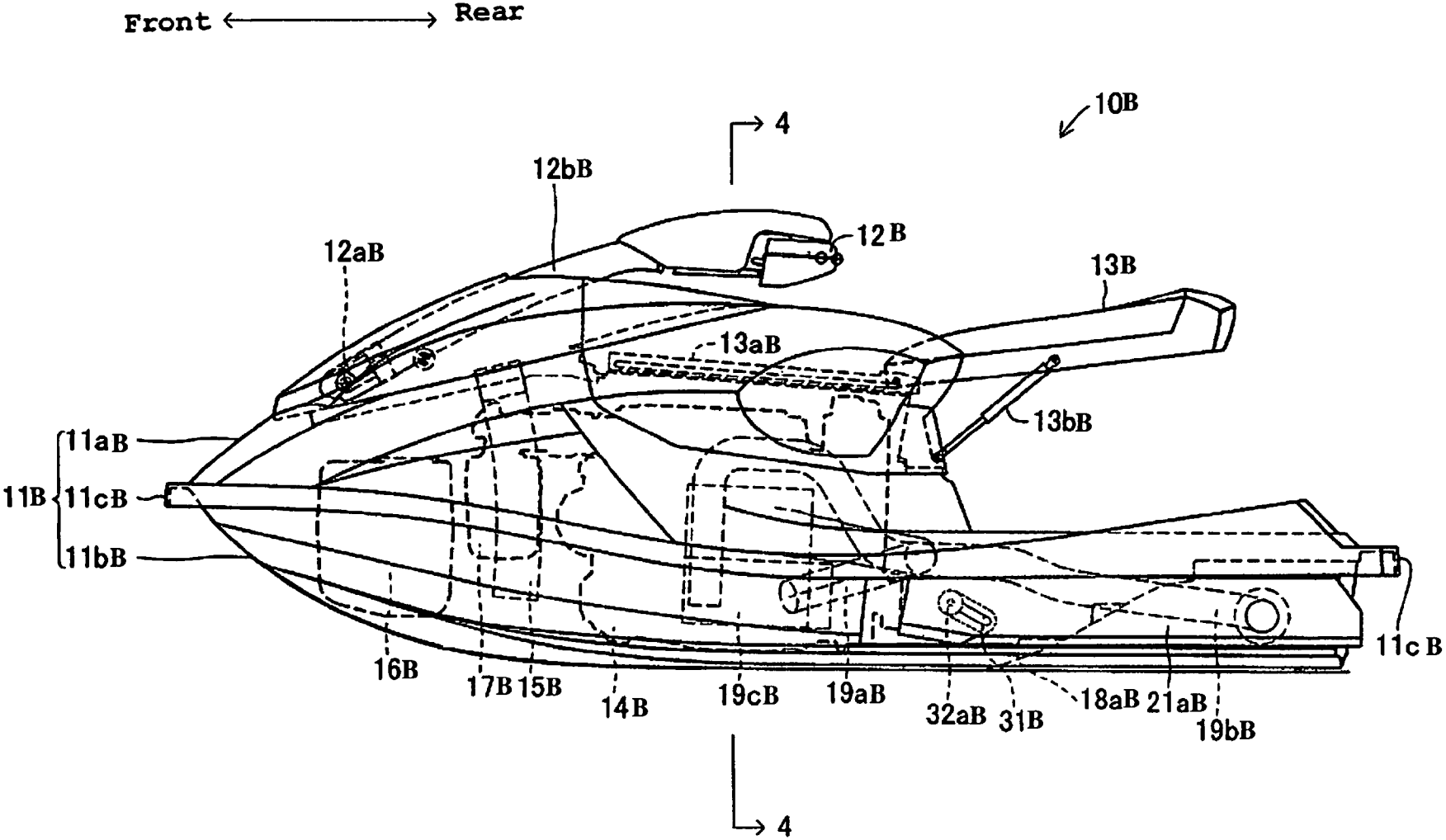
FIG. 30 is a side view showing a small planing boat according to an embodiment of this invention.
Figure 31:
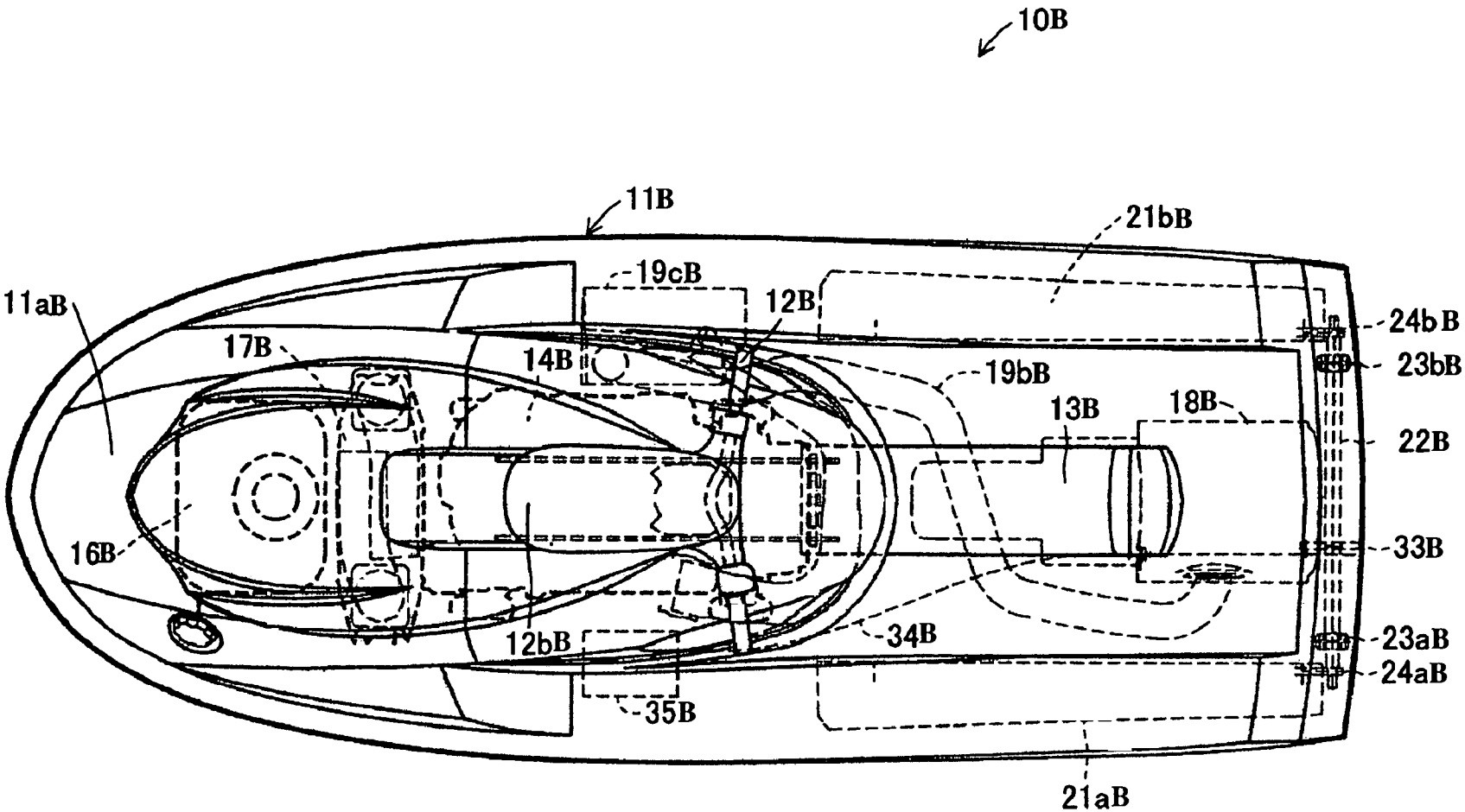
FIG. 31 is a plan view of the small planing boat shown in FIG. 30.

The seat 13B can be configured to be moved for advancing and retraction form the boat body 11B. For example, as described above, when a driver drives the small planing boat 10B in a standing fashion, the seat 13B is housed in the boat body 11B on a rail 13_a_B. When the driver drives the small planing boat 10B in a seating fashion, the seat 13B can be pulled back from the boat body 11B and supported by a support rod 13_b_B, as shown in FIG. 30.

An engine 14B can be provided in the boat body 11B at the central portion of the bottom thereof. An air duct 15B can be included at the front portion of the body 11B, or any other portion, for introducing outside air into the boat body 11B. The air duct 15B can be formed extending from the upper part of the boat body 11B to the bottom thereof, and formed such that it draws outside air from the upper end through a waterproof structure (not shown) provided on the deck 11_a_B and introduces the air from the lower end to the bottom of the boat body 11B. A fuel tank 16B for containing fuel can be provided in the boat body 11B at the front portion.

An intake box 17B can be provided between the engine 14B and fuel tank 16B in the boat body 11B. The intake box 17B supplies air taken into the boat body 11B through the air duct 15B, to the engine 14B. The fuel from the fuel tank 16B can be also supplied to the engine 14B. The fuel supplied from the fuel tank 16B can be atomized by a fuel injection device (not shown) to be sprayed into the cylinder of the engine 14B. At this time, the fuel can be mixed with air supplied from the intake box 17B, to be sent as an air-fuel mixture into the engine 14B, and the mixture explodes detonated by ignition of an ignition device provided in the engine 14B.

A crankshaft (not shown) can extend rearwardly from the rear of the engine 14B. The crankshaft converts the up and down movement of a piston (not shown) by the explosion of the mixture, into a rotational movement.

An impeller shaft (not shown) can be connected to the crankshaft, and the impeller shaft can be connected to a jet propulsion unit 18B provided at the stern of the boat body 11B. The impeller shaft can be connected to an impeller (not shown) mounted inside the jet propulsion unit 18B and transmits the rotational force of the crankshaft by the operation of the engine 14B to the impeller for the rotation thereof.

The jet propulsion unit 18B can be provided with a water inlet 18_a_B (see FIG. 32) opening to the bottom of the boat body 11B and an jet nozzle (not shown) opening to the stern. Water introduced from the water inlet 18_a_B can be emitted from the jet nozzle by the rotation of the impeller, causing a propulsion force for propelling the boat body 11B.

The jet propulsion unit 18B can be mounted to the bottom of the boat body 11B at the stern in a separated relation with the main body of the boat body 11B. The impeller shaft can pass through the casing and can extend from the engine 14B to the jet propulsion unit 18B. A steering nozzle (not shown) can be mounted to the rear part of the jet nozzle. The steering nozzle can be connected to the steering handle 12B by an operation wire and swings to the left and right in response to the operation of the steering handle 12B.

Figure 33:
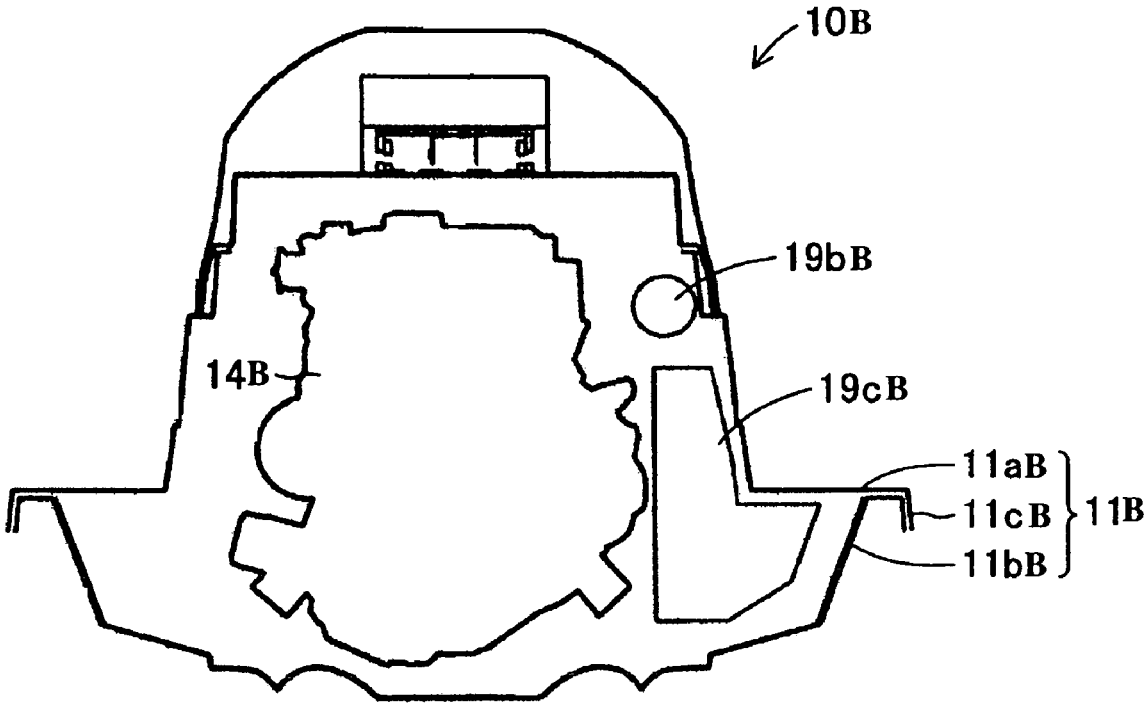
FIG. 33 is a sectional view taken along line 4-4 of FIG. 30.
Figure 34:
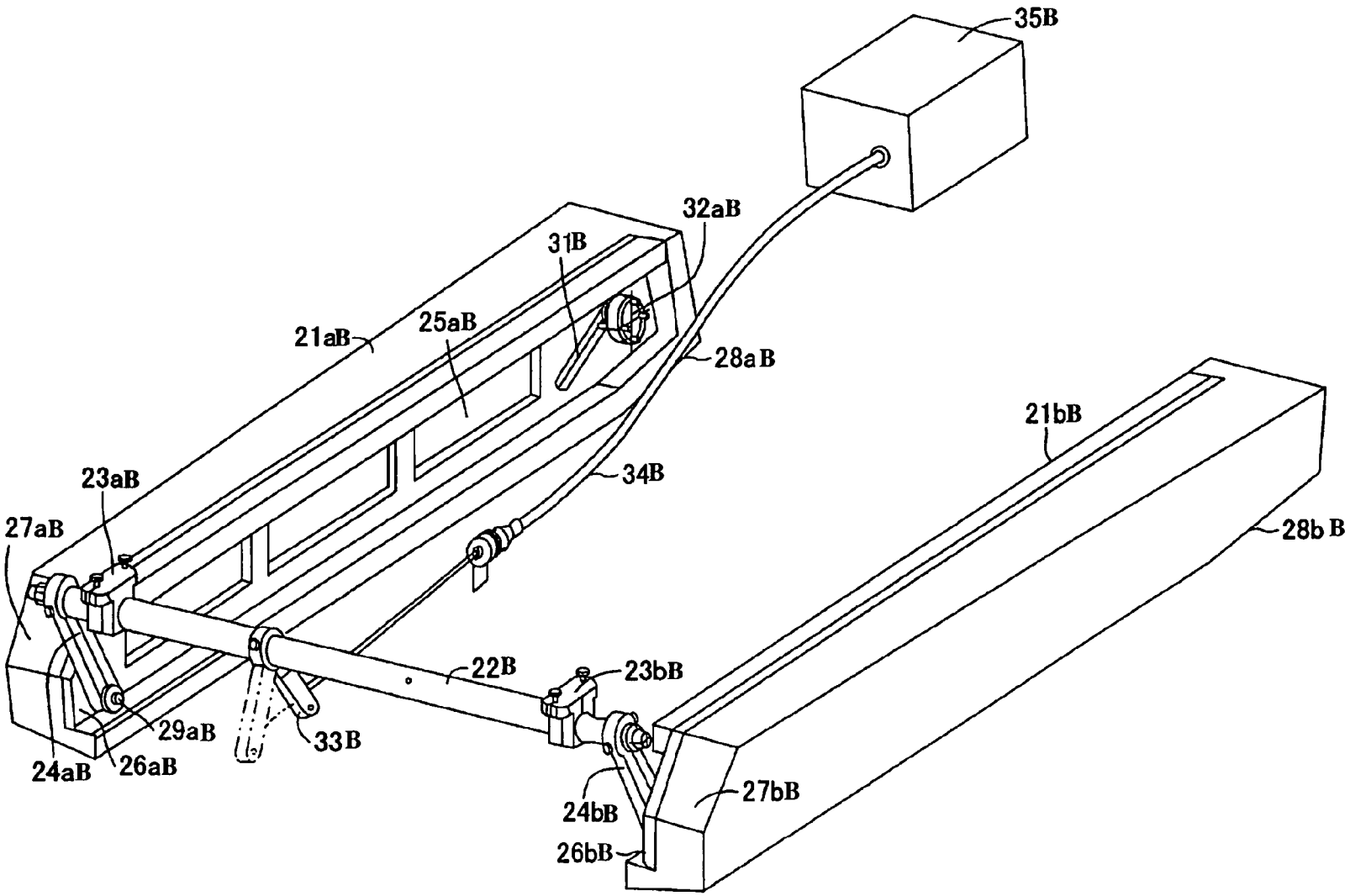
FIG. 34 is a perspective view showing auxiliary bodies mounted to a rotational shaft.

An exhaust device can be connected to the engine 14B with exhaust pipes 19_a_B, 19_b_B and a water lock 19_c_B, however, other configurations of the exhaust system can also be used. The exhaust pipe 19_a_B guides combustion gas discharged from the engine 14B to the water lock 19_c_B. The water lock 19_c_B can be formed by a tank having a wide top portion and a narrow bottom portion, as shown in FIG. 33, to the side surface of which can be connected at the lower side the exhaust pipe 19_a_B and to the upper surface of which can be connected the exhaust pipe 19_b_B.

The exhaust pipe 19_b_B extends upward first from the upper surface of the water lock 19_c_B and then downward toward the rear. The exhaust pipe 19_b_B opens, at the downstream end, to the casing for separating the jet propulsion unit 18B from the main body of the boat body 11B and leads to the outside from the rear end of the boat body 11B.

Figure 32:
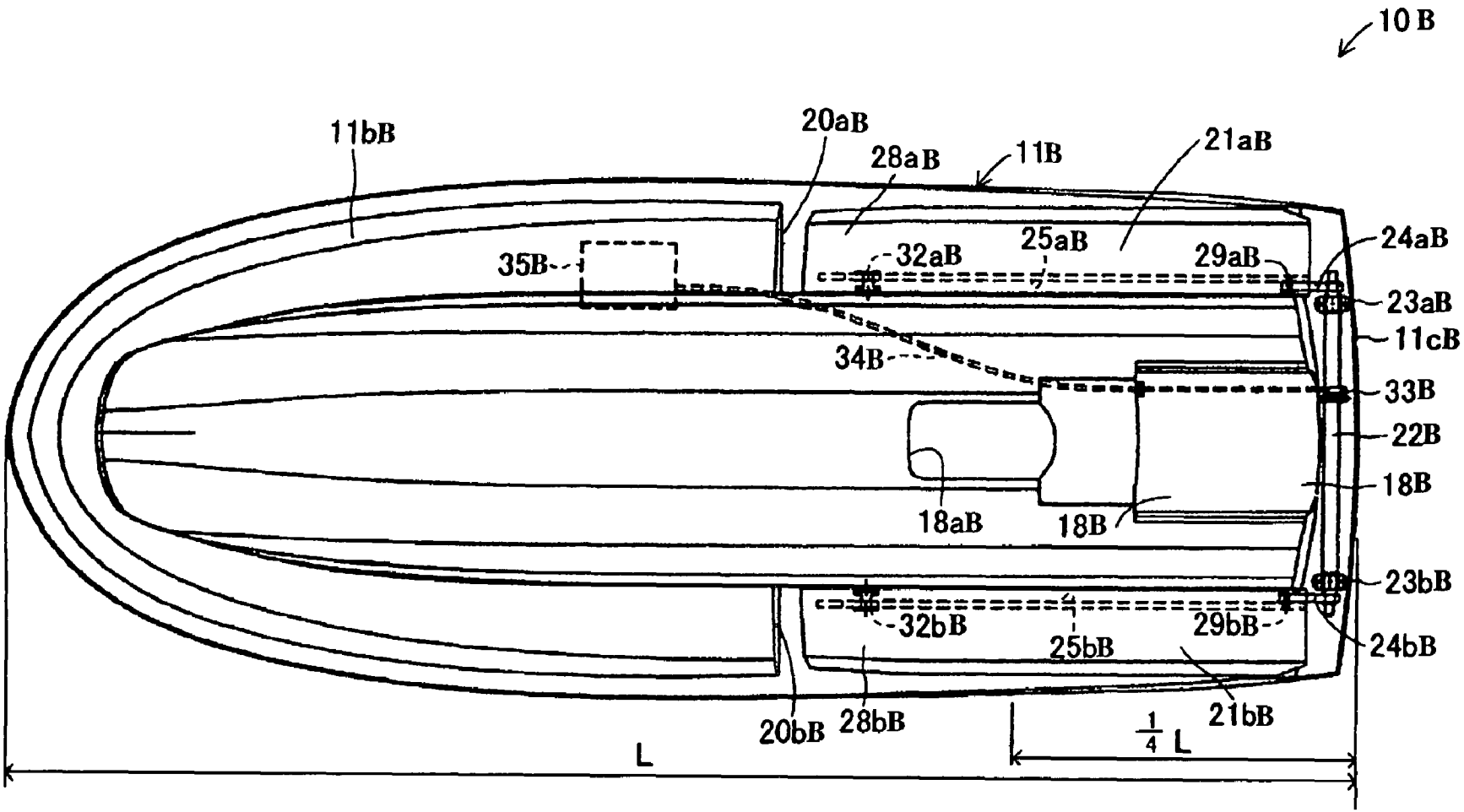
FIG. 32 is a bottom view of the small planing boat shown in FIG. 30.

Further, mounting recesses 20_a_B, 20_b_B can be formed in the rear part and on both sides of the boat body 11B at the bottom, as shown in FIG. 32. An auxiliary body 21_a_B and an auxiliary body 21_b_B can be mounted to the mounting recess 20_a_B and the mounting recess 20_b_B, respectively. The mounting recesses 20_a_B, 20_b_B can be symmetrical to each other and can be provided in the portion of the boat body 11B from the stern to a point near the longitudinal middle thereof. The longitudinal lengths of the mounting recesses 20_a_B, 20_b_B can be each set to be ¼ or more of the total length L of the boat body 11B. The auxiliary body 21_a_B, 21_b_B can be mounted to the boat body 11B through a rotational shaft 22B mounted inside a gunnel section 11_c_B at the stern of the boat body 11B.

That is, mounting members 23_a_B, 23_b_B fixed to the ceiling surface inside the gunnel section 11_c_B can be mounted to the rotational shaft 22B near both ends thereof. The rotational shaft 22B can be mounted to the gunnel section 11_c_B through the mounting members 23_a_B, 23_b_B for rotation about its axis.

Connecting levers 24_a_B, 24_b_B can be mounted at both ends of the rotational shaft 22B for rotation about the axis of the rotational shaft 22B. The rear parts of the auxiliary bodies 21_a_B, 21_b_B can be connected with the other ends of the connecting levers 24_a_B, 24_b_B.

The auxiliary body 21_a_B (21_b_B) can be formed by a long body of approximately a rectangular shape and can optionally be generally symmetrical. A recess 25_a_B (25_b_B) can be formed in the inside surface (surface on the boat body 11B side) of the auxiliary body 21_a_B (21_b_B), and the upper and middle parts at the rear end of the peripheral portion surrounding the recess 25_a_B (25_b_B) can be cut off to form a cutout 26_a_B (26_b_B).

The corner at which the rear surface and the top surface of the auxiliary body 21_a_B (21_b_B) meet, can be cut off to form a slanting surface 27_a_B (27_b_B). Similarly, the corner at which the front surface and the bottom surface of the auxiliary body 21_a_B (21_b_B) meet, can be cut off to form a gentle slanting surface 28_a_B (28_b_B) with a gentle slant at the lower side.

At the rear of the recess 25_a_B (25_b_B) of the auxiliary body 21_a_B (21_b_B), a support shaft 29_a_B (29_b_B) can be mounted to function as a rotation support section. The connecting lever 24_a_B (24_b_B) can be connected at the other end to the support shaft 29_a_B (29_b_B) for rotation. Thus, the connecting lever 24_a_B (24_b_B) can be rotatable about the support shaft 29_a_B (29_b_B) inside the cutout 26_a_B (26_b_B). Also, a support hole 31B can be mounted so as to function as a rotation support section at the front of the recess 25_a_B (25_b_B) of the auxiliary body 21_a_B (21_b_B) (support hole of the auxiliary body 21_b_B is not shown).

The support hole 31B can be formed as an elongated hole having a slant higher toward the front and lower toward the rear. A support shaft 32_a_B (32_b_B) which can be fixed to the side of the boat body 11B can be engaged with the support hole 31B for movement relative to the support hole 31B to prevent slipping-off. Thus, when the rotational shaft 22B is rotated to raise the other end of the connecting lever 24*a*B (24*b*B), the rear part of the auxiliary body 21*a*B (21*b*B) can be raised together with the other end of the connecting lever 24*a*B (24*b*B), and the front part of the auxiliary body 21*a*B (21*b*B) can be raised while the engaged portion of the support shaft 32*a*B (32*b*B) with the support hole 31B is moved from the rear (lower side) of the support hole 31B to the front thereof (upper side).

Figure 35:
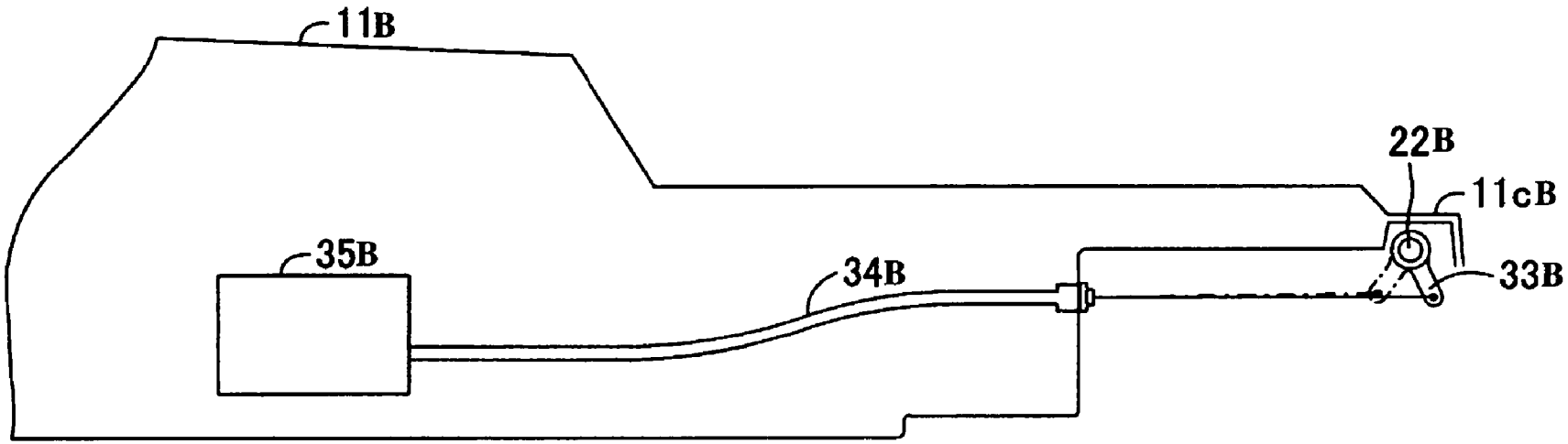
FIG. 35 is a sectional view showing an operation cable being set.

Further, a lever 33B can be fixed in the in the approximate center of the rotational shaft 22B in the longitudinal direction, and the tip of an operation cable 34B can be connected to the tip of the lever 33B. The operation cable 34B can be formed by a push-pull cable, extending from an electric control unit 35B disposed inside the boat body 11B to the lever 33B disposed at the stern, as shown in FIG. 35, and can be advanced and retracted through control of the electric control unit 35B. However, any other actuator can also be used.

Figure 36:
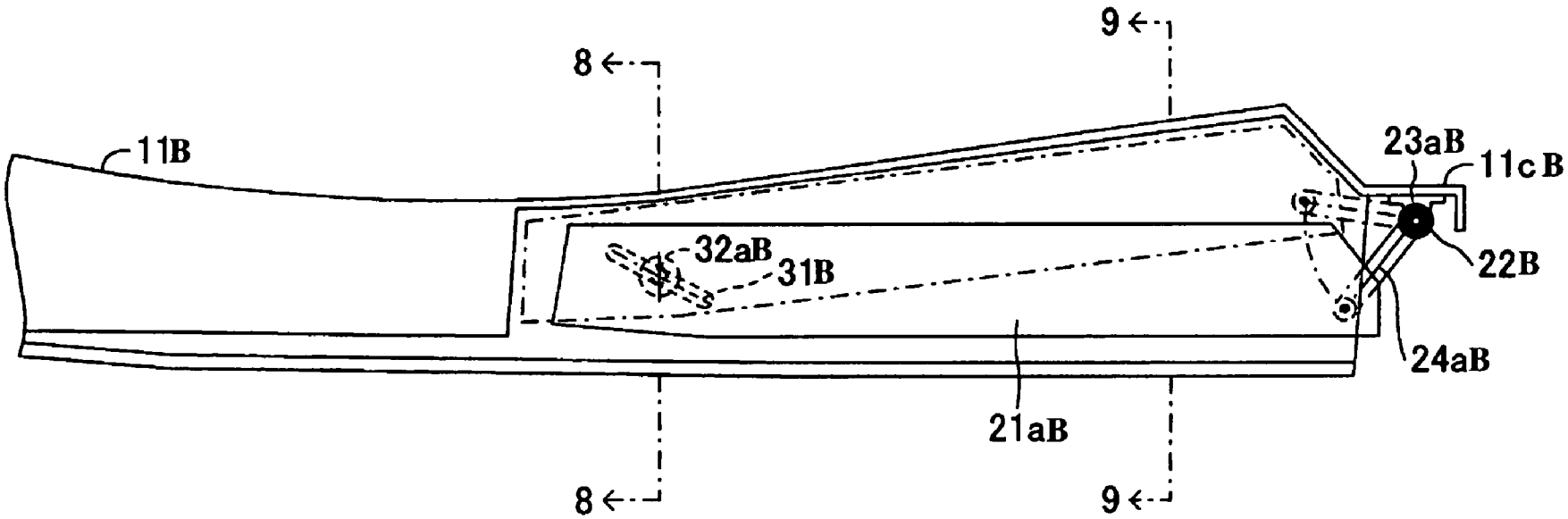
FIG. 36 is a side view showing the auxiliary body being raised and lowered.

The advancing and retraction of the operation cable 34B causes the rotational shaft 22B to rotate and the auxiliary body 21*a*B (21*b*B) is thus moved up and down, as shown in FIG. 36. The electric control unit 35B can be provided with a motor, and the motor can be operated in response to the operation of a user-actuatable input device (not shown) provided near the steering handle 12B, for the advancing and retraction of the operation cable 34B.

In the foregoing arrangement, when a driver drives the small planing boat 10B, he or she holds a grip on the steering handle 12B, with a switch (not sown) disposed near the steering handle 12B being set ON, and moves a throttle lever provided near the grip toward the grip. This causes the engine 14B to be driven in response to the displacement of the throttle lever. For example, as the throttle lever is brought toward the grip, the engine speed is raised and the small planing boat 10B accelerates. On the other hand, as the throttle lever is allowed to move away from the grip, the engine speed lowers and the small planing boat 10B slows.

Figure 37:
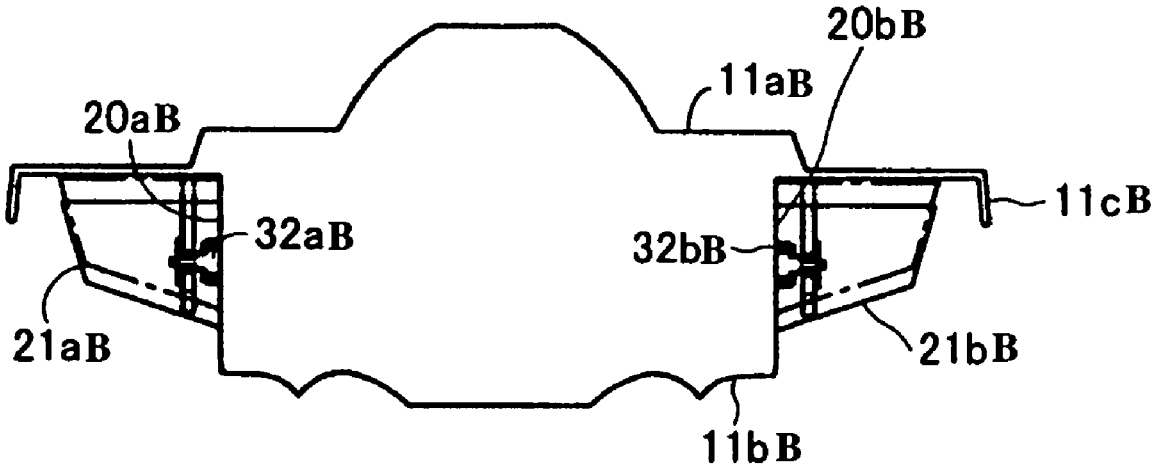
FIG. 37 is a sectional view taken along line 8-8 of FIG. 36.
Figure 38:
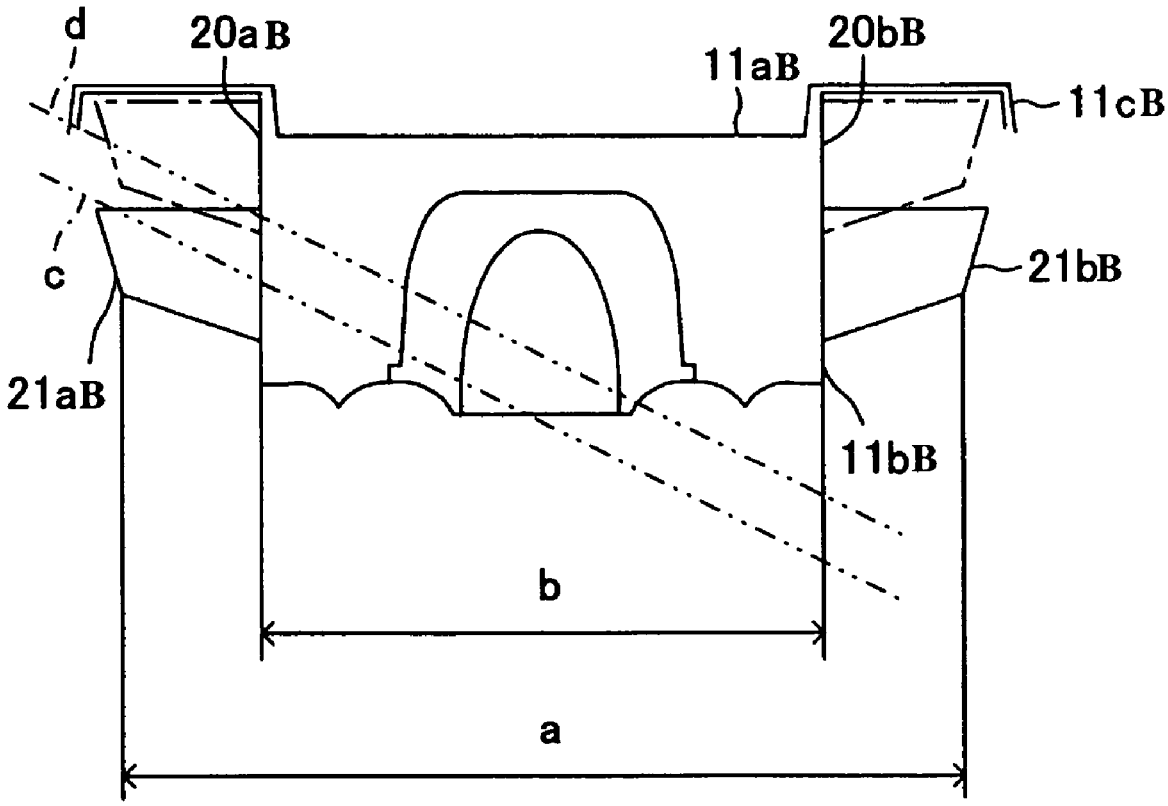
FIG. 38 is a sectional view taken along line 9-9 of FIG. 36.

During operation of the small planing boat 10B in a straight ahead direction, the auxiliary bodies 21*a*B, 21*b*B can be held in a lowered state. This allows the positional relation between the boat body 11B and the auxiliary bodies 21*a*B, 21*b*B to be in a condition as shown in FIG. 37 and FIG. 38 by solid lines, and the chine width has the length of the portion shown in FIG. 38 by symbol a. As such, when the auxiliary bodies 21*a*B, 21*b*B are lowered, the chine width becomes larger, and thus the wetted planing area of the bottom surface of the boat 10B is larger. This results in a more stable cruising condition.

If the small planing boat 10B is turned, the user actuatable input can be controlled to operate the electric control unit 35B, thereby raising the auxiliary bodies 21*a*B, 21*b*B. This allows the positional relation between the boat body 11B and the auxiliary bodies 21*a*B, 21*b*B to be in a condition as shown in FIG. 37 and FIG. 38 by single dot dashed lines. In this condition, the chine width is reduced, as represented in FIG. 38 by symbol (b). In this case, since the chine width becomes smaller, the small planing boat 10B can make a turn with a larger or steeper banking angle.

The double dot dashed line (c) in FIG. 38 shows the level of the water surface when the small planing boat 10B makes a turn with the auxiliary bodies 21*a*B, 21*b*B lowered. The double dot dashed line (d) shows the level of the water surface when the small planing boat 10B makes a turn, with the auxiliary bodies 21*a*B, 21*b*B raised. As shown in these figures, when the auxiliary bodies 21*a*B, 21*b*B are raised, the water inlet 18*a*B is in the body of water during timing, thus allowing the bank angle to be increased without air being sucked into the inlet 18*a*B.

As described above, in the small planing boat 10B, mounting recesses 20*a*B, 20*b*B can be formed in the rear part and on both sides of the boat 11B, and auxiliary bodies 21*a*B, 21*b*B can be mounted to the mounting recesses 20*a*B, 20*b*B such that they can change their vertical positions. Thus, when the auxiliary bodies 21*a*B, 21*b*B are held at a lowered position, the auxiliary bodies 21*a*B, 21*b*B constitute part of a planing surface of the boat body, enlarging the chine width. Thus, the small planing boat 10B can have a better lateral stability.

Further, when the auxiliary bodies 21*a*B, 21*b*B are held at a raised position, the chine width can be narrowed and the boat 10B can make turns with a larger bank angle. Further, since in the small planing boat 10B according to this embodiment, the auxiliary bodies 21*a*B, 21*b*B are provided in the boat body 11B at the stern through a rotational shaft 22B disposed inside a gunnel section 11*c*B, the auxiliary bodies 21*a*B, 21*b*B can be disposed at the same height. Further, the auxiliary bodies 21*a*B, 21*b*B can be moved up and down in synchronization by the operation of the electric control unit 35B. Additionally, since the interior of the gunnel section 11*c*B assumes a dead space in itself, the space can be utilized effectively.

Further, since the auxiliary bodies 21*a*B, 21*b*B are each held reliably at the rear by the rotational shaft 22B and connecting levers 24*a*B, 24*b*B, and at the front, prevented from slipping off the support shafts 32*a*B, 32*b*B, the auxiliary bodies 21*a*B, 21*b*B are not disengaged easily from the boat body 11B. The device for raising and lowering the auxiliary bodies 21*a*B, 21*b*B serves is easier to operate if it is formed with an operation cable 34B and a motor 35B. With the auxiliary bodies 21*a*B, 21*b*B disposed in the mounting recesses 20*a*B, 20*b*B, water does not strike against the fronts of the auxiliary bodies 21*a*B, 21*b*B, and thus the auxiliary bodies 21*a*B, 21*b*B do not substantially increase hydrodynamic resistance.

With the auxiliary bodies 21*a*B, 21*b*B formed at the bottom surfaces with gentle slanting surfaces 28*a*B, 28*b*B, when the auxiliary bodies 21*a*B, 21*b*B are raised, the range of the planing surface of the boat body 11B extends smoothly. Thus, water flows smoothly along the planing surface, and floating debris such as weeds are prevented from entering into the mounting recesses 20*a*B, 20*b*B. Additionally, with the auxiliary bodies 21*a*B, 21*b*B formed at the rear upper surfaces with slanting surfaces 27*a*B, 27*b*B, the auxiliary bodies 21*a*B, 21*b*B can be raised and contained inside the boat body 11B conveniently.

The small planing boat 10B is not limited to the foregoing embodiments, but may be changed and practiced, as appropriate. For example, although in the foregoing embodiments, one rotational shaft 22B is rotated, to thereby raise and lower both of the auxiliary bodies 21*a*B, 21*b*B at the same time, rotation-driving devices may be provided each for raising and lowering their respective auxiliary bodies 21*a*B, 21*b*B, so that raising and lowering of the auxiliary bodies 21*a*B, 21*b*B can be performed separately.

Additionally, although in the foregoing embodiment, the auxiliary bodies 21*a*B, 21*b*B are each formed in the shape of a long block, the auxiliary bodies 21*a*B, 21*b*B can each be formed by a plate-like body disposed horizontally. Further, they may each be formed by a plate-like body having the shape of a letter L in section and provided with an approximately-vertical side portion disposed along the side of the boat body 11B, and a bottom portion extending outwardly of the boat body 11B from the lower end of the side portion and approximately horizontally. Further, the lengths of the mounting recesses 20*a*B, 20*b*B can be changed as appropriate. However, the lengths of the mounting recesses 20*a*B, 20*b*B are each preferably set to be larger than 25% of the longitudinal length of the boat body. However; other proportions can also be used.

A pair of connecting levers or the like can be connected at one ends to the front portions of the auxiliary bodies 21*a*B, 21*b*B for rotation relative to the auxiliary bodies 21*a*B, 21*b*B, and at the other ends to the side portions of the boat body 11B for rotation. As such, a link mechanism can be formed of a pair of connecting levers or the like and levers 24*a*B, 24*b*B. Further, the support holes 31B of the auxiliary bodies 21*a*B, 21*b*B can be formed, in place of elongated holes, by holes which don't move relative to the support shafts 32*a*B, 32*b*B but engage with the shafts for rotation. In this case, elongated holes can be provided in the connecting levers 24*a*B, 24*b*B, for example, so that the support shafts 29*a*B, 29*b*B can move slidingly along the elongated holes. Further, as for arrangements and constructions of portions other than the foregoing, they may also be changed and practiced, as appropriate, within the technical scope of this invention.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A steering system for a small planing watercraft having a hull and a steering pole repositionable by a rider in accordance with his or her own physique or posture, the steering system comprising an engaging portion provided on each side of a forward end portion of the steering pole and an engaged portion provided on the upper forward portion of the hull in the fore to aft direction of the hull, the engaged portion being engageable with the engaging portion such that the steering pole is translatable in the fore to aft direction of the hull, wherein the engaging portion is formed with a support shaft extending from each side of the forward end portion of the steering pole in a generally horizontal direction, the engaged portion being formed with a support shaft slide groove with which the support shaft can slidably engage, the steering system further comprising a guide shaft extending generally horizontally at a rearward portion of the engaging portion relative to the support shaft and extending from each side of the steering pole and a guide shaft slide groove provided above the support shaft slide groove and displaced rearwardly therefrom by a distance, with which the guide shaft can slidably engage.

2. The steering system for a small planing watercraft according to claim 1, wherein a rear portion of the guide shaft slide groove is configured with an arcuate groove section which is formed with its center of curvature positioned at a rear end of the support shaft slide groove, the steering pole being rotatable upwardly and downwardly about an axis defined by the rear end of the support shaft slide groove, when the steering pole is in a rearmost position.

3. The steering system for a small planing watercraft according to claim 2, additionally comprising biasing means for urging the guide shaft upwardly along the arcuate groove section, when the guide shaft is positioned at the arcuate groove section.

4. The steering system for a small planing watercraft according to claim 1, further comprising a support shaft engagement recess provided in an upper forward edge of the support shaft slide groove, with which the support shaft can engage, the engaging recess being configured to maintain the steering pole in a fixed state when the steering pole is in the foremost position and the support shaft engages with the support shaft engagement recess.

5. The steering system for a small planing watercraft according to claim 1, additionally comprising a guide shaft engagement recess provided at a predetermined position on a lower edge of the guide shaft slide groove, with which the guide shaft can engage, the guide shaft engagement recess being configured such that the steering pole is maintained in a fixed state when the guide shaft engages with the guide shaft engagement recess.

6. A steering system for a small planing watercraft having a hull and a steering pole repositionable by a rider in accordance with his or her own physique or posture, the steering system comprising an engaging portion provided on each side of a forward end portion of the steering pole and an engaged portion provided on the upper forward portion of the hull in the fore to aft direction of the hull, the engaged portion being engageable with the engaging portion such that the steering pole is translatable in the fore to aft direction of the hull, the steering system additionally comprising a cable slot formed in the fore to aft direction and provided on the upper forward portion of the hull, and an elastic seal having a gap formed in the longitudinal direction of the cable slot is provided along the periphery of the cable slot, through which a cable runs to connect each control member located at the steering pole with its respective device located on the hull.

7. A steering system for a small planing watercraft having a hull and a steering pole repositionable by a rider in accordance with his or her own physique or posture, the steering system comprising an engaging portion provided on each side of a forward end portion of the steering pole and an engaged portion provided on the upper forward portion of the hull in the fore to aft direction of the hull, the engaged portion being engageable with the engaging portion such that the steering pole is translatable in the fore to aft direction of the hull, the steering system additionally comprising a cable slot formed in the fore to aft direction provided on the upper forward portion of the hull, through which at least one cable runs to connect each control member located at the steering pole with its respective device located on the watercraft, and a bag-shaped member provided on the underside of the periphery of the cable slot to cover part of the cable which can move in accordance with the movement of the steering pole in the fore to aft direction.

8. A small planing watercraft comprising a watercraft body, a plurality of mounting recesses disposed at boundary portions in a rear part of a watercraft body between sides and a bottom thereof, and a plurality of auxiliary bodies mounted to respective mounting recesses, and at least one lifting mechanism configured to change a vertical position of the auxiliary bodies, the auxiliary bodies defining at least part of a planing surface of the watercraft body when the auxiliary bodies are held at lowered positions additionally comprising rotation support sections provided at a front and a rear of at least one of the auxiliary bodies, the lifting mechanism including a link mechanism connecting the at least one auxiliary body to the watercraft body through at least one of the rotation support sections, additionally comprising a rotational shaft extending from starboard to port provided at a stern of the watercraft body, the rotation support sections at the rear of the auxiliary bodies being connected for rotation to both ends of the rotational shaft through connecting levers, and a rotation-driving device for rotating the rotational shaft about its axis is connected to both ends of the rotational shaft.

9. The small planing watercraft according to claim 8, wherein the mounting recesses are formed in a region of the watercraft body from a bow to a stern wherein a starting point of at least one of the mounting recesses is further forward than 25% of the longitudinal length of the watercraft body from the stern.

10. The small planing watercraft of claim 8, wherein a rotation support section provided at the front of an auxiliary body is formed by an auxiliary support hole higher toward the bow and lower toward the stern, wherein the watercraft body is provided with a support shaft for engaging with the auxiliary support hole for movement.

11. A steering system for a small planing watercraft having a hull and a steering pole repositionable by a rider, the steering system comprising a guide assembly connected to the hull and a follower mechanism attached to a forward end of the steering pole, the guide mechanism being configured to allow the steering pole to be translated from a forwardmost position to rearwardmost position, the guide mechanism being further configured to guide the steering pole through an initial rearward movement from its forwardmost position, in which the follower mechanism travels in a translational direction toward an aft end of the watercraft and the steering pole pivots upwardly, and a second range of movement which the steering pole can be pivoted while remaining in its rearwardmost position with the forward end of the steering pole remaining in a generally fixed position.

12. The steering system according to claim 11, wherein the guide mechanism is further configured to retain the steering pole in its rearward most translational position when the steering pole is pivoted to a range of positions lower than its uppermost position.

* * * * *

UNITED STATES PATENT AND TRADEMARK OFFICE

CERTIFICATE OF CORRECTION

PATENT NO. : 7,341,013 B2
APPLICATION NO. : 11/290638
DATED : March 11, 2008
INVENTOR(S) : Futaki Yoshiki It is certified that error appears in the above-identified patent and that said Letters Patent is hereby corrected as shown below:

On drawing sheet 21 of 39 (Below 25aA) (Figure 20), Line 1, Below “25aA” delete “A”.

On column 1, line 48, Delete “at” and insert -- aft --, therefor.

On column 2, line 26, Delete “comprising” and insert -- comprise of --, therefor.

On column 6, line 11, Delete “22;” and insert -- 22, --, therefor.

On column 7, line 51 (Approx.), Delete “31 d” and insert -- 31d --, therefor.

On column 11, line 30 (Approx.), Delete “of” and insert -- as --, therefor.

On column 12, line 49, Delete “embodiment;” and insert -- embodiment, --, therefor.

On column 13, line 26 (Approx.), After “fore” insert -- to --.

On column 14, line 24, Delete “10 A” and insert -- 10A --, therefor.

On column 19, line 29, Delete “52bA52cA” and insert -- 52bA, 52cA --, therefor.

On column 19, line 54, Delete “offspring” and insert -- of spring --, therefor.

On column 20, line 15, Delete “51bA,” and insert -- 51aA, --, therefor.

UNITED STATES PATENT AND TRADEMARK OFFICE

CERTIFICATE OF CORRECTION

PATENT NO. : 7,341,013 B2
APPLICATION NO. : 11/290638
DATED : March 11, 2008
INVENTOR(S) : Futaki Yoshiki It is certified that error appears in the above-identified patent and that said Letters Patent is hereby corrected as shown below:

On column 23, line 59, Delete "(b)." and insert -- b. --, therefor.

On column 24, line 2, Delete "timing," and insert -- turning, --, therefor.

On column 24, line 7, After "boat" insert -- body --.

On column 25, line 7, After "However" delete ";" and insert -- , --, therefor.

Signed and Sealed this

Third Day of March, 2009

JOHN DOLL
*Acting Director of the United States Patent and Trademark Office*